US008035022B2

(12) United States Patent
Wolfram

(10) Patent No.: US 8,035,022 B2
(45) Date of Patent: Oct. 11, 2011

(54) METHOD AND SYSTEM FOR DELIVERING SIGNALING TONE SEQUENCES

(75) Inventor: Stephen Wolfram, Champaign, IL (US)

(73) Assignee: Wolfram Research, Inc., Champaign, IL (US)

( * ) Notice: Subject to any disclaimer, the term of this patent is extended or adjusted under 35 U.S.C. 154(b) by 59 days.

(21) Appl. No.: 12/498,177

(22) Filed: Jul. 6, 2009

(65) Prior Publication Data

US 2009/0266225 A1 Oct. 29, 2009

Related U.S. Application Data

(62) Division of application No. 11/057,574, filed on Feb. 14, 2005, now Pat. No. 7,560,636.

(51) Int. Cl.
*G10H 3/00* (2006.01)

(52) U.S. Cl. ..... 84/609; 455/415; 379/373.01; 379/374.01; 84/649

(58) Field of Classification Search ..... 379/373.01–373.05, 374.01–374.03, 374; 84/600–602, 84/609, 649; 455/415
See application file for complete search history.

(56) References Cited

U.S. PATENT DOCUMENTS 5,802,518 A * 9/1998 Karaev et al. ..... 1/1
5,864,871 A * 1/1999 Kitain et al. ..... 1/1
6,297,439 B1 10/2001 Browne
6,657,116 B1 * 12/2003 Gunnerson ..... 84/615
6,876,958 B1 * 4/2005 Chowdhury et al. ..... 703/7
7,117,259 B1 * 10/2006 Rohwer ..... 709/223
7,139,729 B2 * 11/2006 Nault ..... 705/30
7,143,102 B2 * 11/2006 Fiennes et al. ..... 707/621
7,353,232 B1 * 4/2008 Kalucha et al. ..... 705/64
7,386,535 B1 * 6/2008 Kalucha et al. ..... 1/1
7,404,001 B2 * 7/2008 Campbell et al. ..... 709/231
7,480,864 B2 * 1/2009 Brook et al. ..... 715/720
7,548,325 B2 * 6/2009 Quach et al. ..... 358/1.11
7,549,128 B2 * 6/2009 Snyder et al. ..... 715/792
7,560,636 B2 * 7/2009 Wolfram ..... 84/609
7,742,054 B2 * 6/2010 Nault ..... 345/530
2003/0004831 A1 * 1/2003 Owens ..... 705/26
2003/0105816 A1 * 6/2003 Goswami ..... 709/204
2003/0131715 A1 7/2003 Georges
2004/0085560 A1 * 5/2004 Stringham ..... 358/1.13
2004/0089141 A1 5/2004 Georges et al.
2004/0210945 A1 * 10/2004 Snyder et al. ..... 725/135
2005/0031106 A1 * 2/2005 Henderson ..... 379/142.17
2005/0143054 A1 * 6/2005 Fogel ..... 455/415
2005/0235158 A1 * 10/2005 Shaffer et al. ..... 713/184
2006/0006238 A1 * 1/2006 Singh ..... 235/462.46
2006/0133340 A1 * 6/2006 Rybak et al. ..... 370/338
2006/0146701 A1 * 7/2006 Barnes et al. ..... 370/229

(Continued)

OTHER PUBLICATIONS

Millen, D., "An Interactive Cellular Automata Music Application in Cocoa," 5 pages, International Computer Music Conference, Miami, Nov. 1, 2004, rev. Jan. 2005.

(Continued)

*Primary Examiner* — David S. Warren
(74) *Attorney, Agent, or Firm* — Marshall, Gerstein & Borun LLP

(57) ABSTRACT

In a method for delivering signaling tones to signaling devices or signaling systems, a signaling tone sequence is selected from a set of undelivered signaling tone sequences. The selected signaling tone sequence is removed from the set of undelivered signaling tone sequences, and the selected signaling tone sequence is delivered.

17 Claims, 11 Drawing Sheets

U.S. PATENT DOCUMENTS

| | | | | |
|---|---|---|---|---|
| 2006/0180005 | A1* | 8/2006 | Wolfram | 84/609 |
| 2007/0094108 | A1* | 4/2007 | Nault | 705/30 |
| 2007/0174083 | A1* | 7/2007 | Silverman et al. | 705/1 |
| 2007/0186002 | A1* | 8/2007 | Campbell et al. | 709/231 |
| 2007/0253005 | A1* | 11/2007 | Ola et al. | 358/1.1 |
| 2007/0297594 | A1* | 12/2007 | Barnes et al. | 379/208.01 |
| 2008/0066122 | A1* | 3/2008 | Igoe | 725/81 |
| 2008/0313544 | A1* | 12/2008 | Kleinman et al. | 715/731 |
| 2009/0158155 | A1* | 6/2009 | Quinn et al. | 715/716 |
| 2009/0164564 | A1* | 6/2009 | Willis | 709/203 |
| 2009/0258662 | A1* | 10/2009 | Rybak et al. | 455/466 |
| 2009/0266225 | A1* | 10/2009 | Wolfram | 84/609 |
| 2009/0292991 | A1* | 11/2009 | Snyder et al. | 715/716 |
| 2010/0191608 | A1* | 7/2010 | Mikkelsen et al. | 705/26 |

OTHER PUBLICATIONS

Webb, P., "Random music machine 2000," 1 page, as found at http://fexia.com/randompage.html, printed on Jan. 17, 2006.
Biggs, J., "Wolfram Tones," New York Times, Sep. 29, 2005.
Malone, M., "Silicon Insider: Sweet Music from a Simple Theory," ABC News, Sep. 14, 2005, 3 pages, as found at http://abcnews.go.com/Business/print?id=1126020.
Coates, J., "Stephen Wolfram: Ring tones add up with creative flair," Chicago Tribune Online edition, Sep. 24, 2005, 1 page.
Aughton, S., "Cellular tones for cellular phones," Computer Shopper: News, Sep. 26, 2005, 1 page.
"A New Ringtone for Every Call," Daily News (CA), Oct. 1, 2005, 1 page.
Biggs, J., "Ring-a-ding-dings, unique and endless," Gadgets of the Week-Products on the Cutting Edge, 1 page, Austin America Statesman, Oct. 17, 2005.
Biggs, J., "Trillions of Ring Tones, Like Digital Snowflakes," Geek Notes, Gainesville Sun-One, 1 page, Oct. 10, 2005.
Ball, P., "Making music by numbers online," published online in Nature, 3 pages, Sep. 23, 2005, as found at http://www.nature.com/news/2005/050919/pf/050919-14_pf.html.
"Tired of that ringtone? Maths generates infinite choices," HindustanTimes Indo-Asian News Service, Sep. 27, 2005, 1 page.
"Mattegeni saljer ringssignaler," Computer Sweden, 1 page Oct. 3, 2005, as found at http://computersweden.idg.se/ArticlePages/200510/03/2004100317231....
Szpiro, G., "Meins klingelt anders," NZZ Online, 3 pages, Oct. 13, 2005, as found at http://nzz.ch/2005/10/09/ws/articleD7839.html.
"Swing it, datorn, swing it," NyTeknik, 2 pages, Sep. 30, 2005, as found at http://www.bytechnik.se/pub/ipsart.asp?art_id =42330.
"Distinctive Ringing," 1 page, from the New York Times as published in the Patriot-News, Oct. 4, 2005.
"Playing Patterns," as published in NetWatch, Science, vol. 309, p. 1971, Sep. 23, 2005, ed. M. Leslie.
Peterson, I., "A Mathematical Potpourri," Science News Online, 3 pages, Sep. 17, 2005, vol. 168, No. 12.
Port, O., "Stephen Wolfram: Simple Solutions," Business Week online, 2 pages., Oct. 3, 2005.
Lichte, E., "Your Cell Phone," Stereophile, pp. 17-18, Jan. 2006.
Schwabach, B., "Mathematics program is music to cell phone users' ears," on Computers, Oct. 2005, Week 1, 1 page.
Alleven, M., "Science + Math = Ringtones," WirelessWeek, 1 page, Oct. 15, 2005.
Random Music Machine for Macintosh, Hitsquad Pty Ltd, 3 pp., as found at http://www.hitsquad.com/smm/programs/RandomMusicMachine/, printed on Jan. 17, 2006.
Kline, G., "Music to our Ears," The News-Gazette, 2 pages, Oct. 10, 2005.
Schwabach et al., "Cell phone ring tones mixing math with messages," 1 page, Arkansas Democratic Gazette, Sep. 26, 2005.
Schwabach et al., "The Ringing Sound of Mathematics, " 1 page, Herald Press, Sep. 25, 2005.
Schwabach, "Mathematics is music to cell phone users' ears," 1 page, Fort Pierce Tribune, Sep. 21, 2005.
Schwabach et al., "To find the right number, do ring tones with math, " 1 page, Kansas City Star, Sep. 27, 2005.
Kurzweil CyberArt Technologies, "Ray Kurzweil's Cybernetic Poet" 2pages, found at http://www.kurzweilcyberart.com/poetry/rkcp_overview.php3, (2001).
Yamaha, "Vocaloid," 3 pages, found at http://www.vocaloid.com/en/introduction.html, printed on Jan. 17, 2006.
Kurzweil CyberArt Technologies, "Ray Kurzweil's Cybernetic Poet: How it Works," 4 pages, found at http://www.kurzweilcyberart.com/poetry/rkcp_how_it_works.php3, (2000).
Kurzweil CyberArt Technologies, "Ray Kurzweil's Cybernetic Poet: Features," 3 pages, found at http://www.kurzweilcyberart.com/poetry/rkcp_features.php3 (2000).
"Cellular automata ringtones, " 2 pages, Sep. 9, 2005, as found at http://www.boingboing.net/2005/09/09/cellular_automata_ri.html.
Shah, N., "wolframtones-real synthetic music," 2 pages, Sep. 9, 2005, as found at http://www.neilshah.com/blog/2005/09/wolframtones-real-synthetic-music/.
Cramer, K., "Wolfram Tones," 17 pages, as found at http://www.kathryncramer.com/kathryn_cramer/2005/09/wolframtones.html.
"del.icio.us history for http://tones.wolfram.com/," 28 pages, as found at http://del.icio.us/url/275b0dea38eb34bb4a2ba96972358fb8, Jan. 13, 2006.
Zeitler, W.: "The Music and Magic of the Glass Armonica-About the Glass Armonica," 2 pages, as found at http://www.glassarmonica.com/armonica/index.html, printed on Jan. 30, 2006.
"The EMF Institute- A history of innovation in music and sound, " 74 pages, http://emfinstitute.emf.org/, (2005, 2006).
"Group Report: What is interactive audio and what should it be?", The Eighth Annual Interactive Music Conference Project Bar-B-Q 2003, 6 pages, as found at http://www.projectbarbq.com/bbq03/bbq03r5.htm (2003).
"Java.com Ringtone Remixer," Sun Microsystems, 1 page, as found at http://www.java.com/en/desktop/ringtoneremixer.jsp, printed Jan. 13. 2006.
Mitzenmacher et al., "Estimating Resemblance of MIDI Documents," Proceedings of the 3rd Workshop on Algorithm Engineering and Experiments, available as Lecture Notes in Computer Science 2153, pp. 78-90, 2001, as found at http://www.eecs.harvard.edu/~michaelm/postscripts/ alenex2001.pdf.
"Mozart's Musikalisches Würfelspiel, A Musical Dice Game for Composing a Minuet," 3 pages, as found at http://sunsite.univie.ac.at/Mozart/dice/.
"A Biography of Ray Kurzweil," Kurzweil Technologies, 6 pages, as found at http://www.kurzweiltech.com/raybio.html, printed on Jan. 13, 2006.
"26 Most Fascinating Entrepreneurs: Ray Kurzweil Technologies and other companies," 3 pages, as found at http://www.inc.com/magazine/20050401/26-kurzweil.html (2005).
"The Music Language-Symbolic Composer 5.2 for the Macintosh and Windows," 4 pages as found at http://symboliccomposer.com/, printed on Jan. 30, 2006.
"Together in electric dreams," The Guardian, 5 pages, Jan. 17, 2005, as found at http://www.guardian.co.uk/arts/features/story/0,11710,1391951,00.html.
"Technology: Hit Song Science Basic—for independent musicians and songwriters-Functionality-Understanding how and why it works," Polyphonic HMI, 3 pages, as found at http://www.hitsongscience.com/technology.php, printed on Jan. 13, 2006.
"FAQ," 6 pages, Polyphonic HMI, as found at http://www.hitsongscience.com/faq.php, printed on Jan. 13, 2006.
"SSEYO Koan Pro," Tao Group, 6 pages, as found at http://www.sseyo.com/products/koanpro/index.html, printed on Jan. 13, 2006.
"SSEYO—Mobile Music Making," Tao Group, available at www.sseyo.com, printed on Jan. 13, 2006.
"MetaFilter Community weblog," 2 pages, as found at http://www.metafilter.com/mefi/42667, Jun. 10, 2005.
"sodaconstructor betasound," 2 pages as found at http://www.sodaplay.com/constructor/betasound/index.htm, printed on Jan. 13, 2006.
"Music Creation Software," MP3 Converter, available at http://www.mp3-converter.biz/music-creation-directory/ (2002).
Lee, J., "Mathematical Musick, The Contrapuntal Formula of Dr. Thomas Campion," 9 pages, as found at http://www.shipbrook.com/ieff/counterpoint/, printed on Jan. 13, 2006.

Maurer IV, J., "A Brief History of Algorithmic Composition," 8 pages, Mar. 1999, as found at http://ccrma-www.stanford.edu/~blackrse/algorithm.html.
Burns, K."The History and Development of Algorithms in Music Composition, 1957-1993" Ball State University pub. 1993, 1 page, as found at http://www.sun.rhbnc.ac.uk/Music/Archive/Disserts/burns2.html.
Spiegle, L. "Computer Software by Laurie Spiegel," 4 pages, as found at http://retairy.org/ls/programs.html (2004).
Kline, G., "Prof's software makes computer-generated music sound more natural," Jul. 7, 2005, 3 pages, The News-Gazette Online, as found at http://www.news-gazette.com/localnews/story.cfm?Number=18553.
"Cellular Automaton Music," 1 page, Jun. 22, 2000, as found at http://jmge.net/camusic.htm.
"Automatous Monk: Music from simple programs," 2 pages, as found at http://www.automatous-monk.com, printed on Jan. 13, 2006.
Reiners, P., "Cellular automata and music," 10 pages, May 18, 2004, as found at http://www-128.ibm.com/developerworks/java/library/j-camusic.
Miranda, E., "CAMUS: A Cellular Automata Music Generator," 6 pages, as found at http://website.lineone.net/~edandalex/camus.htm, Jul. 2002.
Millen, D. "Cellular Automata Music, A Computer Music Application for Macintosh Computer, Mac OS X 10.2.8," 2 pages, as found at http://comp.uark.edu/~dmillen/cam.html, printed on Jan. 13, 2006.
Miranda, E., "Introduction to Cellular Automata Music Research," 3 pages, available at http://x2.i-dat.org/~csem/UNESCO/8 (2003).
Miranda, E., "Chaosynth—A Cellular Automata-based Synthesiser," 21 pages, available at http://x2.i-dat.org/~csem/UNESCO/9 (2003).
"FractMus, Fractal Music Composition Software," 8 pages, as found at http://www.geocities.com/SiliconValley/Haven/4386/algorith.html, printed on Jan. 13, 2006.
Abstract of Bilotta, et al., "Reading Complexity in Chua's Oscillator Through Music. Part I: A New Way of Understanding Chaos,"from International Journal of Bifurcation and Chaos [in Applied Sciences and Engineering], vol. 15, No. 2, pp. 253-382, (2005), as found at http://ejournals.worldscientific.com.sg/ijbc/15/1502/S0218127405012156.html.
"Midi-Compositions," 1 page, as found at http://www.uboeschenstein.ch/music/MIDI-COMPOSITIONS.html, printed on Jan. 13, 2006.
Burraston et al., "Cellular Automata in MIDI based Computer Music," 8 pages, as found at http://neuromusic.soc.plymouth.ac.uk/papers/survey-ICMC.pdf, May 2004.
"Arts and Humanities > Music," Wolfram Research, 1 page, as found at http://library.wolfram.com/infocenter/BySubject/Arts/Music, printed on Jan. 13, 2006.
Abstract of Cook, P., "Non-linear recursion in acoustics and music," Proceedings of the Second Int'l Mathematica Symposium, 1997, as found at http://library.wolfram.co.jp/infocenter/Articles/1600/, printed on Jan. 13, 2006.
"NEC Summer School: College/Adult Courses," 5 pages, as found at http://www.newenglandconservatory.edu/summer/courses/Music_Theory.html, printed on Jan. 13, 2006.
"The dreams that stuff is made of, Random Music with Mathematica," 2 pages, Dec. 5, 2004, as found at http://luqui.org/blog/archives/2004/12/05/random-music-with mathematica.
"Mathematica Programming," 4 pages, as found at http://www2.kuh.kumamoto-u.ac.jp/jsato/mathematica.htm, printed on Jan. 13, 2006.
"Table 6, Artists and scientists contributing to making of DNA, genetic and microbe music," 4 pages, as found at http://www.ejbiotechnology.info/content/vol7/issue2/full/8/t6.html, printed on Jan. 13, 2006.
"Mathematica code (non-economics)," Verbeia.com, 2 pages, as found at http://www.verbeia.com/mathematica/mathecon/othercode.html, printed on Jan. 13, 2006.
Rusay et al., "Music from: DNA/ Proteins / Math," available at http://web.archive.org/web/20050205081710/http://education.lInl.gov/msds/music/midi-dna.html, Feb. 5, 2005.
D. Cumming, "Voice of the GoatCactus—User Manual," 2003, available at http://www.goatcactus.com.
W. Mossberg, "Sorting Out the Three-Ring Circus of Ringtones," Wall Street Journal, p. D8, Jan. 5, 2005.
R. Newcomb, "Music in the Air: a theoretical model and software system for music analysis and composition," Organised Sound, Vol. 3, No. 1, Cambridge University Press, 1998, available at http://www.partialmusic.com/pdf/MITA.pdf.
I. Girton, "An Introduction to Species Counterpoint," 2004, available at http://www.listeningarts.com/music/general_theory/species.

* cited by examiner

METHOD AND SYSTEM FOR DELIVERING SIGNALING TONE SEQUENCES

CROSS-REFERENCE TO RELATED APPLICATION

This application is a divisional of U.S. patent application Ser. No. 11/057,574, filed on Feb. 14, 2005, and entitled "Method and System for Generating Signaling Tone Sequences," which is hereby incorporated by reference herein in it entirety for all purposes.

TECHNICAL FIELD

This disclosure generally relates to signaling devices such as telephones, cellular phones, pagers, personal digital assistants, etc., and signaling systems such as paging systems, public address systems, intercom systems, etc. More particularly, this disclosure relates to techniques for delivering signaling tones to be used by such devices and/or systems.

DESCRIPTION OF THE RELATED ART

A business office may include many telephones. Typically, these telephones are supplied by a single service provider, and the telephones are all of a same or similar make and/or model. Each telephone may be provided with a few ring tones from which a user can select a subset for use by the user's telephone. For example, the user can select a first ring tone to be used for calls received from inside the office, and a second ring tone for calls received from outside the office. Or perhaps the user can select a first ring tone for calls from a particular phone number, and a second ring tone for other calls. The telephones typically will be provided with the same default ring tone. Because each user can select from the same few ring tones, many users may choose the same ring tones to be used on their telephones. Many users typically will not change the ring tone from the default ring tone. As a result, it may be difficult for a person away from his or her desk and hearing a telephone ring to determine if the ring is coming from his or her telephone or from someone else's telephone.

Similarly, cellular phones of a particular make and/or model may be provided with a same few ring tones from which a user can select a subset for use by the user's cellular phone. Because each user can select from the same few ring tones, many users may choose the same ring tones to be used on their telephones. Many users typically will not change the ring tone from a default ring tone. Also, ring tones of cellular phones of different makes and/or models may sound very similar. As a result, it may be difficult for a person in a public place (or even with just one other person) who hears a cellular phone ring to determine if the ring is coming from his or her cellular phone or from someone else's cellular phone.

Cellular phone service providers may permit a user to add ring tones to their telephone. For example, a user may select one or more ring tones from a plurality of additional ring tones offered by the service provider or a third party. For a fee, the user can then download the ring tones to his or her cellular phone for use. The additional ring tones may include monophonic tones, polyphonic tones, audio clips of popular songs, and audio clips of sound effects. At present, many providers exist for specialized ring tones. Essentially all of them offer a fixed selection of ring tones of modest overall size, with end users choosing out of this set. While this provides more variety as compared to default ring tones, popular ring tones are often selected repeatedly by many users.

DETAILED DESCRIPTION

One of the described embodiments is directed to a method for generating signaling tones. The method comprises the acts of generating a plurality of raw data sequences using at least one recursive system, and converting the plurality of raw data sequences into a plurality of signaling tone sequences that follow a set of aesthetic music principles.

Another described embodiment is directed to a computer readable medium having stored thereon machine executable instructions. The machine executable instructions are capable of causing the machine to generate a plurality of raw data sequences using at least one recursive system, and convert the plurality of raw data sequences into a plurality of signaling tone sequences that follow a set of aesthetic music principles.

Yet another described embodiment is directed to a system for generating signaling tones. The system comprises a raw data sequence generator configured to use at least one recursive system to generate a plurality of raw data sequences. The system also comprises a converter configured to convert the plurality of raw data sequences into a plurality of signaling tone sequences that follow a set of aesthetic music principles.

Still another described embodiment is directed to a method for delivering signaling tones to signaling devices or signaling systems. The method comprises the acts of selecting a signaling tone sequence from a set of undelivered signaling tone sequences, and removing the selected signaling tone sequence from the set of undelivered signaling tone sequences. The method also comprises the act of delivering the selected signaling tone sequence.

Another described embodiment is directed to a computer readable medium having stored thereon machine executable instructions. The machine executable instructions are capable of causing the machine to select a signaling tone sequence from a set of undelivered signaling tone sequences, and remove the selected signaling tone sequence from the set of undelivered signaling tone sequences. The machine executable instructions are also capable of causing the machine to deliver the selected signaling tone sequence.

Generating Signaling Tone Sequences

Figure 1:
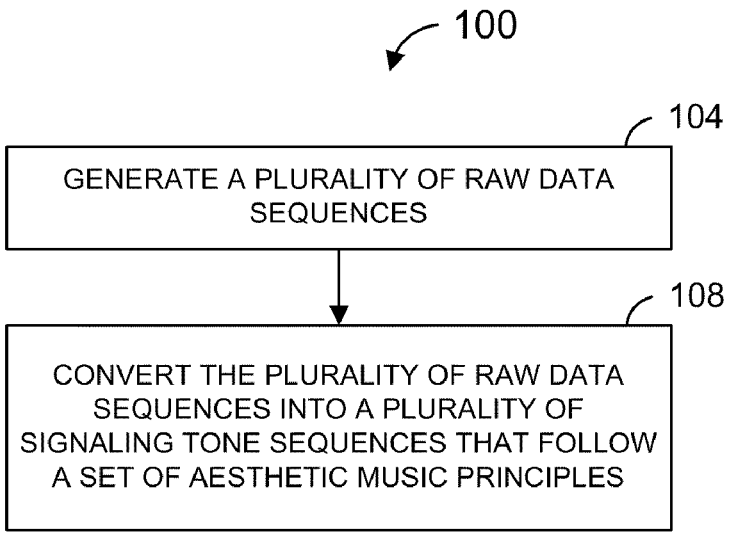
FIG. 1 is a flow diagram of an example method for generating a plurality of signaling tone sequences that follow a set of aesthetic music principles.

FIG. 1 is a flow diagram of an example method 100 for generating a plurality of signaling tone sequences for use in telephones, cellular phones, pagers, personal digital assistants, consumer electronic devices, toys, games, paging systems, public address systems, intercom systems, etc. A signaling tone sequence may be a sequence of musical tones that signify an event such as a telephone call, a page of a particular person, a page of a group of persons, an emergency, etc. The method 100 can be used to generate a large number of different signaling tone sequences. It may be possible to use the signaling tones generated by a method such as the method 100 to provide a large number of devices and/or systems with unique signaling tone sequences. Thus, a cellular phone manufacturer could provide each of a large number of cellular phones with one or more unique signaling tone sequences, for example. As another example, persons could download unique signaling tone sequences to their cellular phones. Such unique signaling tone sequences could help persons distinguish their cellular phone rings from those of other persons' cellular phones.

Similarly, unique signaling tone sequences could be loaded to telephones for use in an office setting, for example. This could help an office worker distinguish his or her telephone ring from those of other persons' telephones. Also, unique signaling tone sequences could be loaded to pagers, personal digital assistants (PDAs), two-way radios, set top boxes, desktop computers, laptop computers, tablet computers, etc. Further, signaling tone sequences could be loaded to toys, games, consumer devices, etc. For example, signaling tone sequences could be loaded to a toy, and the toy could output different signaling tone sequences in response to various events.

As another example, unique signaling tone sequences could be loaded to signaling systems (e.g., paging systems for the home or office, public address systems, intercom systems, etc.). This could help a person distinguish a paging tone sequence generated by a paging system, for instance, indicative of a particular event (e.g., a page of that person, the arrival of a particular person, an emergency, a request for a class of personnel, etc.) from paging tone sequences indicative of other events.

In general, a tone sequence can be considered an abstract object with numerous degrees of freedom that increase with its length. Notes of various pitches and durations can be combined in any order, in principle, for every instrument or "voice" in a musical sequence. The number of possible combinations increases exponentially with length, so the abstract possibility space of even moderately long tone sequences is very large. This phenomenon is familiar from digit representations of numbers. For instance, it is fairly easy to provide a unique phone number to anyone on earth, since the number of possible combinations of 10 digits, each anything from 1-10 and varying independently, is 10 billion. With tone sequences to be used as signaling tones, however, it would be useful to ensure that selections out of the large abstract possibility space of conceivable tone sequences are each aesthetically acceptable. Most tone sequences out of this possibility space would likely sound like discordant, random notes and would be quite unappealing to the human ear. The example method 100 provides a technique for, in effect, automatically selecting a large number of aesthetically acceptable tone sequences out of the large abstract possibility space of conceivable tone sequences.

Referring now to FIG. 1, at a block 104 a plurality of raw data sequences are generated using one or more recursive systems. Generally, a recursive system may be a system that determines a succession of elements by operating on one or more preceding elements according to one or more rules, and/or at least by operating on a succession of inputs according to a repeated application of one or more rules. Any of a variety of recursive systems, including known recursive systems, may be used to generate the raw data sequences. Examples of recursive systems that may be used will be described below.

At a block 108, the plurality of raw data sequences generated at the block 104 are converted to a plurality of signaling tone sequences that follow a set of aesthetic music principles. Converting the plurality of raw data sequences may comprise, for example, mapping each of at least some of the plurality of raw data sequences into data representing a musical sequence that may include a single melody for monophonic tones, a single voice including musical chords, multiple voices on the same instrument (bass and melody lines e.g.), multiple independent instrument "tracks" for polyphonic tones, etc. The mapping may incorporate some or all of some set of aesthetic music principles such that each musical sequence generated by the mapping follows some or all of the aesthetic music principles. Additionally or alternatively, tone sequences generated by the mapping may be filtered to remove musical sequences that do not follow the set of aesthetic music principles. Also, the recursive system may optionally incorporate some set of the aesthetic music principles such that the act of converting the raw data sequences to the signaling tone sequences is less complicated.

The signaling tone sequences may be in any of a variety of formats suitable for use in generating audio including, for example, a format suitable for providing to an analog-to-digital converter (ADC), a Musical Instrument Digital Interface (MIDI) format, a Waveform audio format, a Sun audio format, a Macintosh audio format, a RealAudio audio format, a Moving Picture Experts Group Layer-3 Audio (MP3) format, etc. Additionally, a signaling tone sequence may be represented as a symbolic data structure that describes characteristics of the tone sequence (such as note, duration, instrument, etc.). Abstract data structures are typically used in programming and enable one to translate from one sound format to another.

Figure 2:
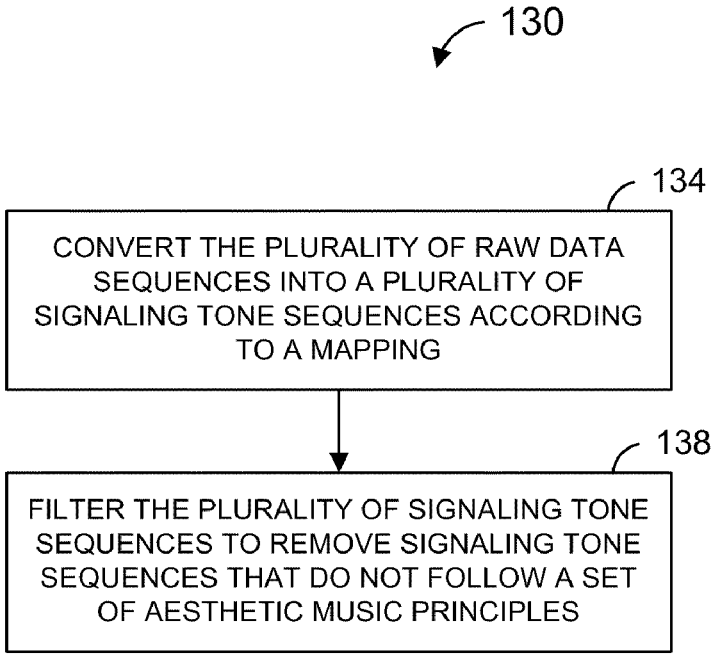
FIG. 2 is a flow diagram of an example method for converting a plurality of raw data sequences to a plurality of signaling tone sequences that follow a set of aesthetic music principles.

The block 108 of FIG. 1 may be implemented using a variety of techniques. FIG. 2 is a flow diagram of one example method 130 that may be used to implement the block 108. At a block 134, each of the raw data sequences generated at the block 104 of FIG. 1 is converted into a tone sequence according to a mapping. Mapping the plurality of raw data sequences may comprise, for example, mapping each of the plurality of raw data sequences into data representing a musical sequence. Abstractly, a mapping may be a mathematical function, computer subroutine, or data transform that operates on any formal structure of the kind expected by that mapping, and returns a definite formal structure, which may in general by quite different from the originating formal structure. Examples of mappings that may be utilized will be discussed in more detail below.

Then, at a block 138, the plurality of tone sequences generated at the block 134 may be filtered to remove tone sequences that do not follow a set of aesthetic music principles. Whereas a mapping transforms any formal structure given to it while generally leaving the number of structures operated on unchanged, filters leave each instance unchanged but selectively drop cases or elements from the set received. Example filters for removing tone sequences that do not follow a set of aesthetic music principles will be described below.

Optionally, the order of the blocks 134 and 138 could be reversed. For example, the raw data sequences generated at the block 104 of FIG. 1 could be filtered to remove raw data sequences that, when converted to tone sequences, would not follow the set of aesthetic music principles. Then, the filtered raw data sequences could be converted into tone sequences according to the mapping. In another variation of FIG. 2, an additional filtering step could be added prior to the block 134. For example, the raw data sequences generated at the block 104 of FIG. 1 could be filtered to remove raw data sequences that, when converted to tone sequences, would not follow some of the set of aesthetic music principles. Then, at the block 138, the plurality of tone sequences generated at the block 134 may be filtered to remove tone sequences that do not follow the remaining aesthetic music principles, for instance.

Recursive Systems to Generate Raw Data Sequences

Referring again to FIG. 1, raw data sequences may be generated using one or more recursive systems. Examples of recursive systems that may be used to generate the plurality of raw data sequences include cellular automata described in Stephen Wolfram, *A New Kind of Science*, (2002). *A New Kind of Science* also describes other examples of recursive systems that may be used including "mobile automata," "generalized mobile automata," "Turing machines," "substitution systems," "sequential substitution systems," "tag systems," "cyclic tag systems," "register machines," "symbolic systems," systems based on numerical operations, iterated maps, etc.

Examples of other recursive systems that may be used include pseudorandom number generators, random walks, Markov chains, enumerated constraint systems, or combinations of such elements, such as random subsets of a possibility space defined by a set of constraints. Some portions or dimensions of a data sequence (e.g. a rhythm pattern or single instrument's part) may be obtained from one of these sources while other portions are obtained from a different one. Known recursive systems may be modified, and new recursive systems may be developed. For example, a recursive system could be developed that generates raw data sequences amenable, at least on the average, to conversion to signaling tone sequences that follow a particular set of aesthetic music principles. One of ordinary skill in the art will recognize that many variations and combinations are possible.

As further described in *A New Kind of Science*, relatively simple recursive systems (e.g., simple computer programs such as cellular automata) may be used to generate complex outputs. For example, the rule 110 cellular automaton, which acts locally on a string of 0s and 1s in a manner that can be specified by 8 binary digits, and which can be executed as a single short line of computer code, is known to be capable of universal computation—meaning that it could in principle be programmed to execute any finite algorithm, by being fed a suitable initial condition of 0s and 1s. Moreover, all types of recursive systems mentioned above are known to exhibit so-called "class 4 behavior" (as defined in Wolfram "Cellular Automata", 1983). Class 4 behavior occurs in subsets of all types of recursive systems mentioned above and produces organized, structured patterns that significantly differ both from random and purely repetitive patterns. The combination of inherent small scale structure and overall complexity shown by class 4 behaviors make formal systems exhibiting it promising places to find interesting tone sequence generators. As will be understood by those of ordinary skill in the art, however, other and potentially more complex recursive systems may also be utilized to generate raw data sequences.

In one implementation, a recursive system may comprise an enumerated constraint system. Generally, an enumerated constraint system sets up some ordering that lists all the possible ways of satisfying a set of constraints. Conceptually, each "internal choice" left to the system is like a "digit" in a sequence of numbers (of mixed base, rather than needing to be base 10 or binary) that together specify the set of choices. Generally, the more accurately the enumerated constraint system tracks the aesthetic music principles, the less complicated the subsequent mapping and/or filtering steps need be.

As an example, one might start by characterizing a melody by the "leaps" within it, or other simple motifs (e.g., a characteristic chord progression). Each possible choice of these major thematic elements may then be assigned some digits. Placement of these within a sequence of a given length is then a second subset of choices encoded in another block of digits. Details outside this structure can be added in various ways, but many of these ways might violate other constraints. So one can look for only those choices of these details that allow the constraints to be met. For example, the directions of some leaps or the size of small changes could be picked so that the total change for the whole melody is zero or up one octave or up or down a perfect fifth.

Sometimes previous choices will not allow the constraints to be satisfied for a corresponding portion of a search tree. Often a whole set of possible later choices will satisfy the constraints. The null cases may be thrown out and all the others kept by list operations, for example, and each way remaining gets its own later digit-value in a last block 2specifying the system. At the end, one is left with a one-to-one relationship between numbers and patterns that fit the constraints—i.e., this is the first way of satisfying the constraints, this is the second, this is the third, etc.

With small systems one can enumerate all the possibilities, and this may work for relatively short tone sequences. For much longer ones, one can replace exhaustive enumeration at some points in the process with random choices that satisfy that portion instead, and still get variety by enumerating the other, remaining choices.

The raw data sequences generated may be in a variety of formats. For example, a raw data sequence may comprise a one-dimensional array of numbers, a two-dimensional matrix, a three-dimensional matrix, etc. Additionally, numbers in the raw data sequence may be in a variety of formats. For example, numbers in a raw data sequence may comprise integers, integers from a limited range (e.g., [0, 1], [−1, 0, 1], [0, 1, . . . , 9], etc.), rational numbers, floating point numbers, etc. Large scale variety can be specified by structures of elements each with only a few possible values by grouping multiple elements, as is readily familiar from binary coding.

In selecting and/or designing a recursive system for use in particular implementations of a signaling tone sequence generator, it may be useful to consider what types of music tend to be appealing to the human ear. Human beings readily hear and remember identical musical phrases, and notice relations of similarity that are not exactly equal but preserve something—e.g. a progression that uses the same intervals, a mirrored set of changes, or movements that begin and end similarly while varying in between. In short, human beings notice small-scale structure. In addition, there are some characteristic progressions that tend to be displeasing to the human ear (discord). Entirely random sequences may be unappealing because they lack structure and do not avoid displeasing characteristic progressions. At the other extreme, overly repetitive or simplistic changes—single note steps as in pure scales, sequences containing only 2 or 3 notes, etc—may be considered boring.

Appealing musical sequences tend to mix local structure with ongoing variation and liveliness. Recursive systems that generate raw data sequences adhering to simple, local, deterministic rules tend to create small elements of structure spontaneously, because they must act in the same way when the local pattern of their input or data is the same. They tend to produce characteristic motifs, because certain patterns are favorably produced by that rule, more often than others, while another class of possible patterns does not appear at all because that local rule does not allow them to occur. When the rule is too simple in its overall behavior, however, resulting signaling tone sequences may be considered boring.

Thus, recursive systems which generate raw data sequences that adhere to simple deterministic rules and that nevertheless have complicated overall behavior may be useful. On the other hand, recursive systems that do not utilize simple deterministic rules may be utilized as well, particularly for shorter sequences or in conjunction with filters. For instance, as mentioned above, a pseudorandom number generator can be used to pick each note in a sequence, or more realistically a random walk or Markov chain may use successive random determinations to pick subsequent notes, related to those just before. In these cases, and especially in the first, the percentage of raw data sequences that, upon mapping and/or filtering, result in tone sequences adhering to the set of aesthetic music principles may be much lower as compared with raw data sequences that adhere to simple deterministic rules and that nevertheless have complicated overall behavior. Or much more stringent filters may be required, rejecting large numbers of potential sequences but keeping a small portion that passes the filters.

Example Mappings

Referring again to FIG. 2, raw data sequences may be converted into a tone sequence according to a mapping (block 134). A variety of mappings from raw data sequences to signaling tone sequences can be utilized. Some example mappings are discussed below. It will be understood by those of ordinary skill in the art, however, that many other mappings may be utilized as well.

In general, there are potentially many dimensions of a piece of abstract music (e.g., multiple voices, rhythms, melodies, etc.). A mapping that sets each of these varying entirely independently based on entirely distinct and uncorrelated aspects of the raw data sequence, tends to make random sounding tone sequences. This may be appealing for small portions of a tone sequence or for basic motifs, but may be unappealing in larger tone sequences. Larger tone sequences tend to need more structure. Mappings that take many possible states of the underlying raw data to similar places in musical terms may provide such structure.

When 3-5 things (pitch, duration, chord combinations, overall range, etc), for example, can vary among a range of possible values for each term of a long tone sequence, these independent choices multiply to create a very large number of possible combinations. If each is allowed to varying with complete independence, with full use of the possible range in every variable, one will rapidly get lost in a huge possibility space. This may leave little for the ear to hang onto and recall—most sections of the sequence will have little or nothing to do with any other portion of it. As an alternative, a more restrictive mapping that may limit use of at least several of the possible variables (e.g. only using a few voices, a few chord combinations, a few note durations, one or two octaves, etc.) may be used. Some repetition will tend to arise if the space is limited to a certain degree, and this will give the ear something to notice and recall when it is heard again.

In general, the mappings used in a particular implementation may depend on the characteristics of the raw data sequences generated in that implementation. For example, if the raw data sequence comprises only values of 0 and 1, a mapping may comprise mapping a plurality of numbers in the raw data sequence to a single tone in the signaling tone sequence. As one specific example, the sum of a plurality of numbers in the raw data sequence may be mapped to a musical note. As another example, if the raw data sequence comprises only values of −1, 0, and +1, the mapping may comprise mapping values in the raw data sequence to step changes in the signaling tone sequence. For instance, if a value in the raw data sequence is zero, a corresponding tone in the signaling tone sequence may be chosen as the previous tone. If a value in the raw data sequence is −1, a corresponding tone in the signaling tone sequence may be chosen as one note lower than the previous tone. Similarly, if a value in the raw data sequence is +1, a corresponding tone in the signaling tone sequence may be chosen as one note higher than the previous tone. If the raw data sequence comprises integers in the range 0 to 9, for example, the mapping may comprise mapping each integer to a unique musical note. If the raw data sequence comprises integers in a larger range, for example, the mapping may comprise mapping ranges of integers to musical notes.

The mapping may also depend on the type of raw data sequence. For example, the raw data sequence may comprise a one-dimensional array, a two-dimensional matrix, a three-dimensional array, a tree structure, a graph structure, etc. If the raw data sequence comprises a one-dimensional array, each individual value of the raw data sequence may be mapped to a corresponding tone in the signaling tone sequence. As another example, if the raw data sequence comprises a one-dimensional array, a plurality of values of the raw data sequence may be mapped to one corresponding tone in the signaling tone sequence. If the raw data sequence comprises a two-dimensional matrix, each row of the matrix may be mapped to a tone in the signaling tone sequence. For instance, each row may be mapped to a musical note based on the sum of the row. As a similar example, each column of the matrix may be mapped to a tone in the signaling tone sequences. As yet another example, the rows of the matrix could be concatenated to form a one-dimensional array, and each value in the matrix may be mapped to a tone in the signaling tone sequence.

A mapping may also comprise a mapping of a raw data sequence into musical notes of different durations. For example, some mapped tones in a signaling tone sequence may comprise quarter notes and others may comprise eighth notes. Additionally or alternatively, raw data sequences may be mapped musical notes of other durations as well such as whole notes, sixteenth notes, etc. If a raw data sequence comprises a two-dimensional matrix, for example, each row of the matrix may be mapped to a musical note and the duration of the note may be determined based on some function of the values in the row. For example, if the values in the matrix comprise only 0 and 1, the duration of a note may be determined by the numbers of 0's and 1's in the corresponding row. For instance, if there are more 0's, the note will be a quarter note, and if there are more 1's, the note will be an eighth note. If the raw data sequence comprises a one-dimensional array of integers, a duration of a note corresponding to a value in the array may be determined based on a characteristic of the value. For example, if a value is divisible by three, the note may be determined as an eighth note, and if the value is not divisible by three, the note may be determined as a quarter note.

As another example, if the raw data sequence comprises a one-dimensional array of integers, a duration of a note corresponding to a value in the array as well as a duration of one or more neighboring notes may be determined based on a characteristic of the value. For example, if a value is not divisible by three, the note may be determined as a quarter note. But if the note is divisible by three, the note as well as the subsequent note may be determined as both eighth notes.

The mapping may include processing the raw data as well. For example, an average of some or all of the values in the raw data sequence could be determined, and then the average could be subtracted from the corresponding values in the raw data sequence. Other examples of processing of the raw data that could be performed include normalizing some or all of the raw data sequence, filtering some or all of the raw data sequence, limiting some or all of the raw data sequence. A further example comprises appending the first value in the raw data sequence to the end of the sequence. This may help a generated signaling tone sequence to sound musically "resolved," for example. Some or all of a signaling tone sequence may be filtered, limited, tones may be inserted or eliminated, etc.

Some portions of the processing involved in a mapping may be performed at other points in the overall procedure. For example, some or all of such processing could be performed as part of the block 104 of FIG. 1. Or some or all of such processing could be performed separately from the block 108 of FIG. 1 or the blocks 134 and 138 of FIG. 2.

One of ordinary skill in the art will recognize a wide variety of possible mappings. For example, raw data sequences may be mapped into signaling tone sequences that comprise chords, multiple voices, polyphonic tones, etc. Thus, it will be understood that the mapping techniques described herein are merely examples and that many other techniques can be used as well.

Aesthetic Music Principles

The above-described methods aim to generate signaling tone sequences that follow a set of aesthetic music principles. Any of a variety of aesthetic music principles, including known aesthetic music principles, may be utilized. Examples of known aesthetic music principles that may be employed include requirements of cantus firmus melodies, rules of counterpoint, etc. Generally, there are numerous detailed requirements that musical compositions should follow in various musical traditions. Sometimes, such requirements are specific to a composition form or a particular scale. Tonality is a common aesthetic rule, though it may be relaxed for deliberately chromatic pieces, for example. A piece in C major may not only use that scale but make much greater use of C F and G notes than of others in the scale, favor certain chord progressions and forbid others, etc. Those of ordinary skill in the art are aware of a wide variety of aesthetic rules for music in various genres.

Additionally, new aesthetic music principles may be developed, or criteria employed that are distinct from aesthetic musical ones. For example, music principles could be developed that reflect aesthetically pleasing and/or distinctive characteristics unique to signaling tone sequences, or unique to a particular signaling application or instrument. Ease of hearing or distinguishing a sequence in the presence of certain kinds of background noise might be more important than aesthetic considerations, in the case of an alarm signal for example.

Generally, it may be determined if data representative of musical sounds follows a set of aesthetic music principles based on measurable and/or determinable characteristics of the data. For example, aesthetic music principles may be represented as one or more requirements that the audio data should satisfy. If a requirement is not met, it may be determined that the audio data does not follow an aesthetic music principle associated with that requirement. Several example requirements corresponding to aesthetic music principles will be described below. It is to be understood that the described requirements are merely examples and that other requirements may be used additionally or alternatively. For example, some subset of these example requirements could be used, along with zero or more other requirements.

One example requirement is that a change from a first tone in a tone sequence to a last tone in the sequence should be −5, 0, or +7 steps in a certain musical scale, corresponding to changes in pitch of one octave or a perfect fifth. For a different scale or mode, a different set of allowed changes might be used, as the integer number of steps between notes differs depending on which notes are included or excluded from a given scale. Musically, the requirement might be to end on a tonic.

Another example requirement is that a tone sequence should include a change between adjacent tones of greater than two steps in a musical scale, and such a change should occur on average at least every three tones. This avoids sequences that closely replicate stepping through the underlying scale, which can sound dull if prolonged. Similar requirements may be used in which a different minimum step size is specified and/or a different frequency of larger changes is specified, for example.

An additional example requirement is that the difference (in steps of a musical scale) between a highest note and a lowest note in a tone sequence should be at least eight steps. Long sequences with too restricted a range can sound overly simplistic. A different size minimum difference may also be used, and the right absolute figure may depend on the musical scale used and the length of the sequence.

The following example requirements are based on what are believed to be requirements of cantus firmus melodies. Note that in practice one may sometimes relax some of these traditional requirements, e.g. by using only a subset of them.

1. The tone sequence should begin and end on the tonic of a key or a final of a mode. A penultimate note should be a note a step above the tonic or final (the second tonal or modal degree).

2. All notes in the sequence should be of the same length. For example, each note may be a whole note.

3. Adjacent notes in the sequence should not be the same.

4. A range of a tone sequence should be limited to an octave. Optionally, the range may be allowed as far as a $10^{th}$ partial above a tonic. Alternatively, the range may be limited to a 6th partial above the tonic. Also, the range may be limited to a 5th partial above the tonic.

5. The tone sequence should comprise only diatonic notes.

6. The tone sequence should comprise eight to thirteen notes.

7. Conjunct (stepwise) (e.g., a step of only one musical note in a musical scale) movement should predominate, interspersed by three or four judiciously employed leaps (e.g., a step of more than one musical note). If a leap is greater than a $3^{rd}$ partial, it should be followed immediately by motion, preferably by step, in the opposite direction to that of the leap.

8. Only the following melodic intervals should be used: major and minor 2nds, major and minor 3rds, perfect 4ths, perfect 5ths, minor 6ths (ascending only), and perfect 8 ves. Optionally, ascending major 6ths may be used.

9. The tone sequence should not include two successive leaps in the same direction.

10. The tone sequence should not include a repetition of groups of notes and/or sequences.

11. The tone sequence should include a climax on a high note, which should be melodically consonant with the first and final notes (i.e. at a distance of a major or minor 3rd, perfect 4th or 5th, major or minor 6th, perfect 8 ve, or major or minor 10th). The climactic note should not be repeated.

12. The tone sequence should be roughly balanced between ascending and descending motion. The tone sequence should change direction several times.

The following example requirements are based on what are believed to be rules of counterpoint. In particular, with regard to part writing, the rules of counterpoint include:

1. The third of a chord should not be doubled.

2. Parts should not be crossed.

3. The seventh of the dominant seventh chord resolves down to the third of the tonic chord.

With regard to chord progressions, the rules of counterpoint include:

1. A tonic can be followed by any chord.

2. A supertonic can be followed by V, III, IV, VI, and VII.

3. A mediant can be followed by VI, IV, II, and V.

4. A subdominant can be followed by V, I, VI, VII, II, and III.

5. A dominant can be followed by I, VI, III, and IV.

6. A submediant can be followed by II, V, IV, and III.

7. A leading tone can be followed by I, VI, III, and V.

With regard to ranges of voices, the rules of counterpoint include:

1. A first measure should be a soprano.

2. A second measure should be an alto.

3. A third measure should be a tenor.

4. A fourth measure should be a bass.

With regard to types of motion, the rules of counterpoint include:

1. In similar motion, both lines move should move in the same direction.

2. In contrary motion, both lines should move in opposing directions.

3. In oblique motion, one line should stay constant and on line should move.

4. A measure having a parallel octave and a parallel fourth movement should be avoided.

5. A measure having a parallel fifth movement should be avoided.

With regard to doubling, the rules of counterpoint include:

1. When the root is in the bass, double the root.

2. When the fifth is in the bass, double the fifth.

3. When the third is in the bass, double the soprano if the soprano is not a third. If the soprano is a third, double the root.

With regard to open and closed positions, the rules of counterpoint include:

1. With an open position, a distance between soprano and tenor should be more than an octave.

2. With a closed position, a distance between soprano and tenor should be less than an octave and/or all three or four voices should be within one octave.

As described above with reference to FIG. 1 and FIG. 2, tone sequences may be filtered to eliminate tone sequences that do not satisfy a set of requirements representing aesthetic music principles. One of ordinary skill in the art will recognize that some of these requirements may be incorporated into the block 104 of FIG. 1 and/or into the step 134 of FIG. 2. In other words, instead of filtering out tone sequences that do not meet a requirement, the tone sequences could be generated such that the requirement is always met. As a simple example, if a requirement is that tone sequences should remain in a range of notes, the range of notes in the tone sequences could be limited by limiting the range of values of a raw data sequence and/or limiting the range of tones into which a raw data sequence is mapped.

Example Filters

Referring again to FIG. 2, tone sequences may be filtered to eliminate tone sequences that do not follow a set of aesthetic music principles (block 138). As described above, aesthetic music principles may be represented as one or more requirements that a tone sequence should satisfy. Thus, a filter may determine if tone sequences satisfy a set of requirements, and may eliminate tone sequences that do not. A particular implementation of a filter may incorporate one or more of any of the above described requirements related to aesthetic music principles. Additionally or alternatively, other requirements may be utilized.

In general, very strict filters may be utilized if there is little structure in the raw data sequences and when the mappings are loose, or many tone sequences are otherwise generated that would not follow the set of aesthetic music principles. On the other hand, less strict filters may be utilized if the raw data sequence is fairly structured, for example. In the abstract, one might have only a filter, operating on entirely random sequences whenever they fail to meet aesthetic criteria—but in practice this would mean throwing out almost all sequences generated. At the other extreme, an enumeration scheme that ensures all sequences it produces already meet aesthetic criteria laid down at the outset, may not need any filtering at all. In practice, simple filters readily make minor but noticeable improvements to the sets of sequences produced.

One of ordinary skill in the art will recognize that many types of filters may be used. For example, a filter may determine if tone sequences satisfy all of a set of requirements, and if a tone sequence does not satisfy all of the requirements the tone sequence may be discarded. As another example, a filter may discard tone sequences that do not satisfy a minimum number of requirements in a set of requirements. As yet another example, a filter may discard tone sequences that do not satisfy all requirements in a first set of requirements and a minimum number of requirements in a second set of requirements.

In some implementations, the filtering of tone sequences may be omitted. For example, at least some aesthetic music principle requirements may be incorporated into the generation of raw data sequences. Additionally or alternatively, at least some aesthetic music principle requirements may be incorporated into the mapping of raw data sequences into tone sequences. For example, the range of notes in signaling tone sequences could be limited by limiting the range of values of raw data sequences and/or limiting the range of tones into which raw data sequences are mapped.

Filters may be used to ensure, for example, that tone sequences end on a tonic, are not unduly repetitive, that intervals are varied or include occasional sufficiently large leaps, that overall movement is adequate to sound interesting, and the like. It may be easier to ensure these results by throwing out tone sequences that fail to do so, rather than by elaborate prior selection of recursive systems or mappings that force these outcomes. Those of ordinary skill in the art will recognize many additional ways to ensure that tone sequences adhere to a set of music principles.

Systems for Generating Signaling Tone Sequences

Figure 3:
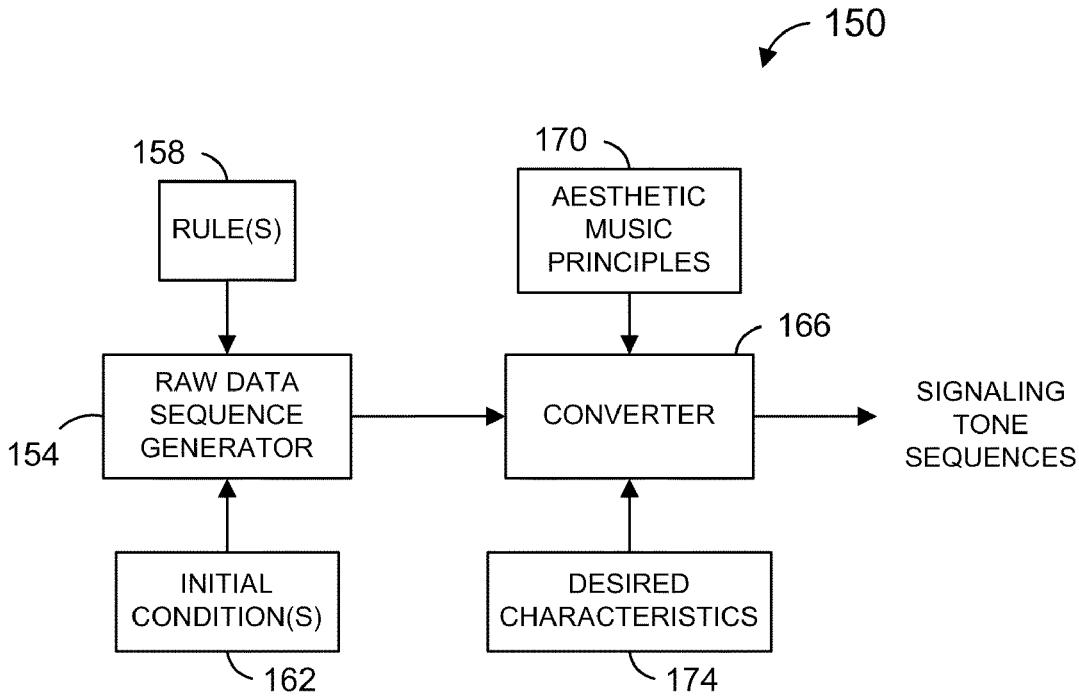
FIG. 3 is a block diagram of an example system for generating a plurality of signaling tone sequences that follow a set of aesthetic music principles.

FIG. 3 is a block diagram of an example system 150 for generating a plurality of signaling tone sequences. A system such as the system 150 may be used to implement the method 100 of FIG. 1, for example. The system 150 comprises a raw data sequence generator 154 to generate a plurality of raw data sequences. The raw data sequence generator 154 may implement one or more recursive systems such as the recursive systems described above.

The raw data sequence generator 154 may be configured according to one or more rules 158 that specify the operation of the raw data sequence generator 154. Additionally, the raw data sequence generator 154 may be provided with one or more initial conditions. The raw data sequence generator may generate a plurality of raw data sequences by generating raw data sequences based on a single initial condition 162 and according to different instances in the class of the rules 158, for example. Additionally, the raw data sequence generator may generate a plurality of raw data sequences by generating raw data sequences based on different initial conditions 162 and according to a single rule 158, for example. Similarly, the raw data sequence generator may generate a plurality of raw data sequences by generating raw data sequences based on different initial conditions 162 and according to different instances from within the class of rules 158. As yet another example, the raw data sequence generator may generate a plurality of raw data sequences by generating a single large raw data sequence based on a single initial condition 162 and according to a single rule 158, and then subdivide the single large raw data sequence into a plurality of smaller raw data sequences.

The plurality of raw data sequences generated by the raw data sequence generator 154 are provided to a converter 166 that converts the plurality of raw data sequences to a plurality of signaling tone sequences that fulfill a set of aesthetic music principles 170. In some instances, the number of signaling tone sequences generated by the converter 166 may be significantly less than the number of raw data sequences provided to the converter 166. In other instances, the number of signaling tone sequences generated by the converter 166 may be the same or similar to the number of raw data sequences provided to the converter 166. Usually, mappings conserve the number of sequences and filters reduce that number. The overall converter may pass all, most, or only a few of the original data sequences, depending for example on how much of the processing effort is done by filters rather than mappings and/or the raw data sequence generator.

The converter 166 may generate signaling tone sequences according to desired characteristics or options information 174. In general, the same piece of abstract music can be "performed" in various ways. The desired characteristics information 174 may include indications of various desired characteristics of the generated signaling tone sequences such as an absolute tempo, a musical scale, a starting octave and mode, an instrument or set of instruments, etc. The results can also be given in a variety of data formats (e.g., MIDI, wav, etc).

The overall design of the example system 150 is purposefully modular. Each step in the process can be varied independently of the previous step, using the abstract data form reached at that point in the overall flow.

Figure 4:
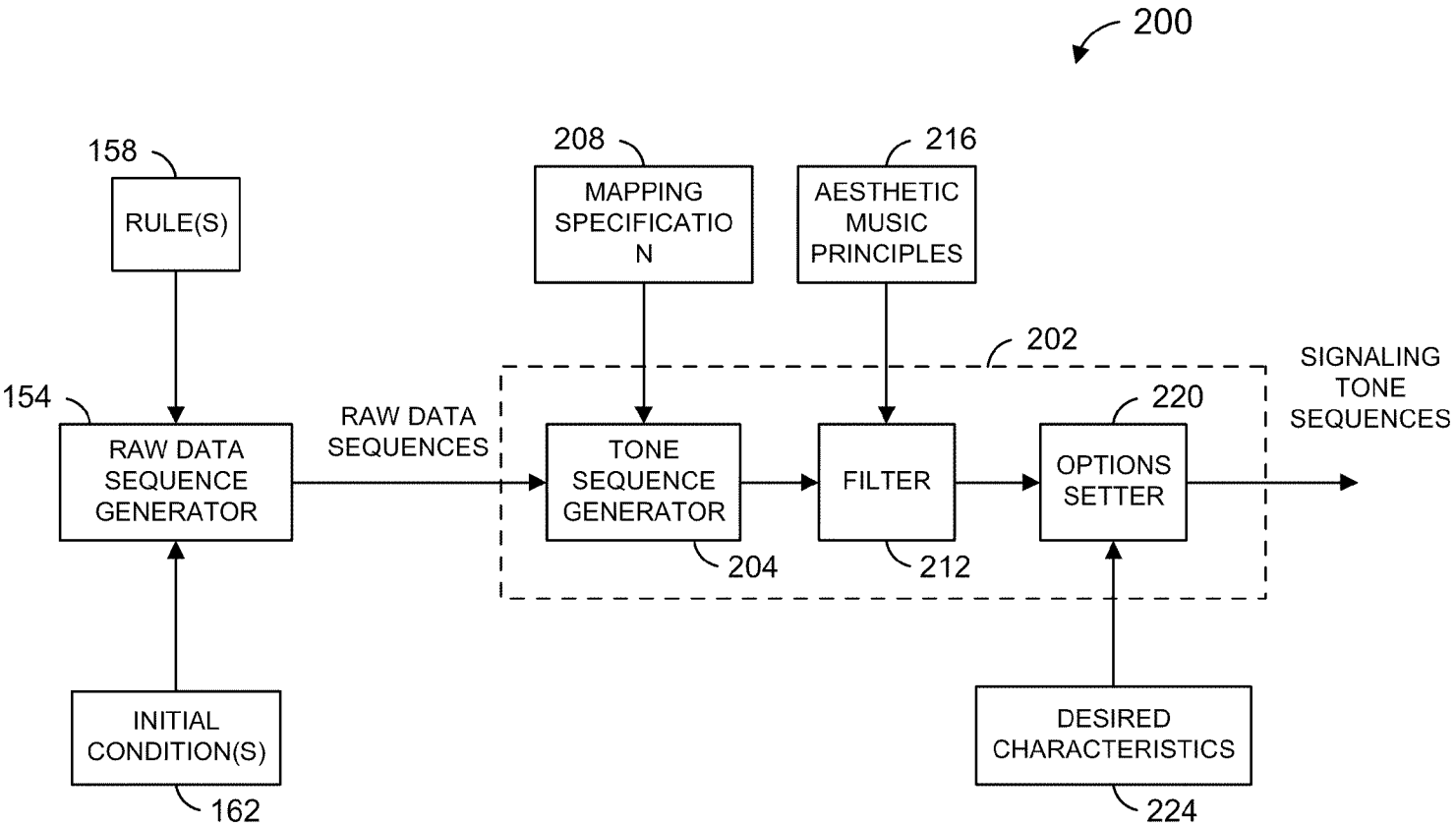
FIG. 4 is a block diagram of another example system for generating a plurality of signaling tone sequences that follow a set of aesthetic music principles.
Figure 5:
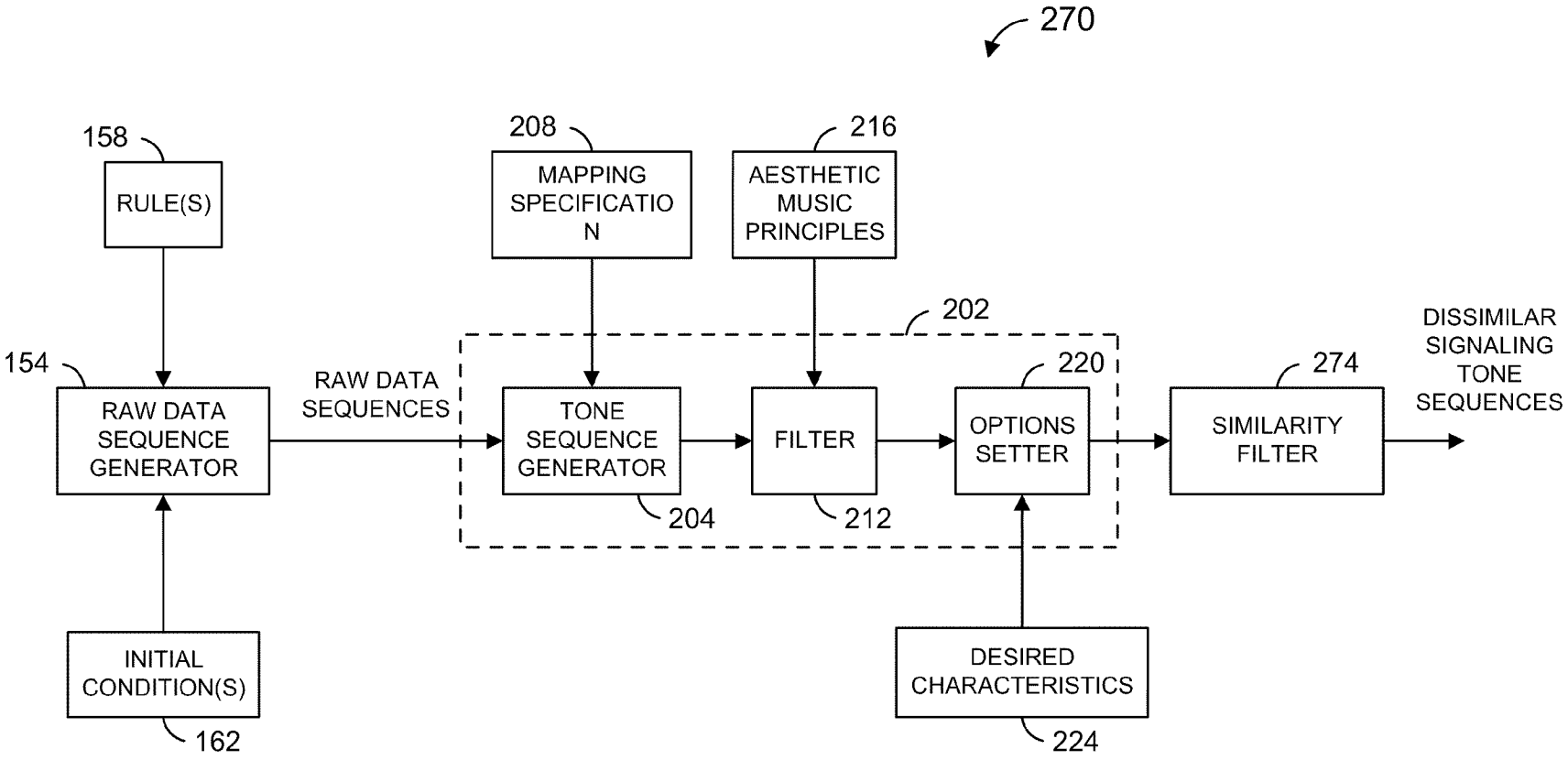
FIG. 5 is a block diagram of still another example system for generating a plurality of signaling tone sequences that follow a set of aesthetic music principles.

The converter 166 may be implemented using any of a variety of techniques. FIG. 4 is a block diagram of another example system 200 having one implementation of a converter. The system 200 includes elements common with the system 150 of FIG. 3, and also includes a converter 202. The converter 202 comprises a tone sequence generator 204 that converts each raw data sequence into a signaling tone sequence according to a mapping specification 208. The tone sequence generator 204 may utilize one or more of the example mappings described above. Additionally or alternatively, the tone sequence generator 204 may utilize other mappings.

The tone sequence generator 204 may be configured to generate tone sequences of in a variety of formats including a format particularly suited to a filter 212. The filter 212 receives tone sequences generated by the generator 204 and discards tone sequences that do not follow at least some aesthetic music principles 216. The filter 212 may utilize one or more of the example filter techniques describe above. Additionally or alternatively, the filter 212 may utilize other techniques.

The converter 202 may optionally include an options setter 220 that ensures that the output of the converter 200 conforms to desired characteristics 224. For example, the options setter 220 may ensure that signaling tone sequences are at a selected tempo, at a selected musical scale, at a selected octave, in a selected data format (e.g., MIDI), etc.

In another implementation, the options setter 220 may be implemented, at least partially, by the tone sequence generator 204. For example, the tone sequence generator 204 may be provided with some or all of the desired characteristics 224 and then may generate signaling tone sequences accordingly. In still another implementation, the output of the tone sequence generator 204 may be operated on by the options setter 220 prior to filtering by the filter 212.

Filtering Similar Signaling Tone Sequences

Figure 6:
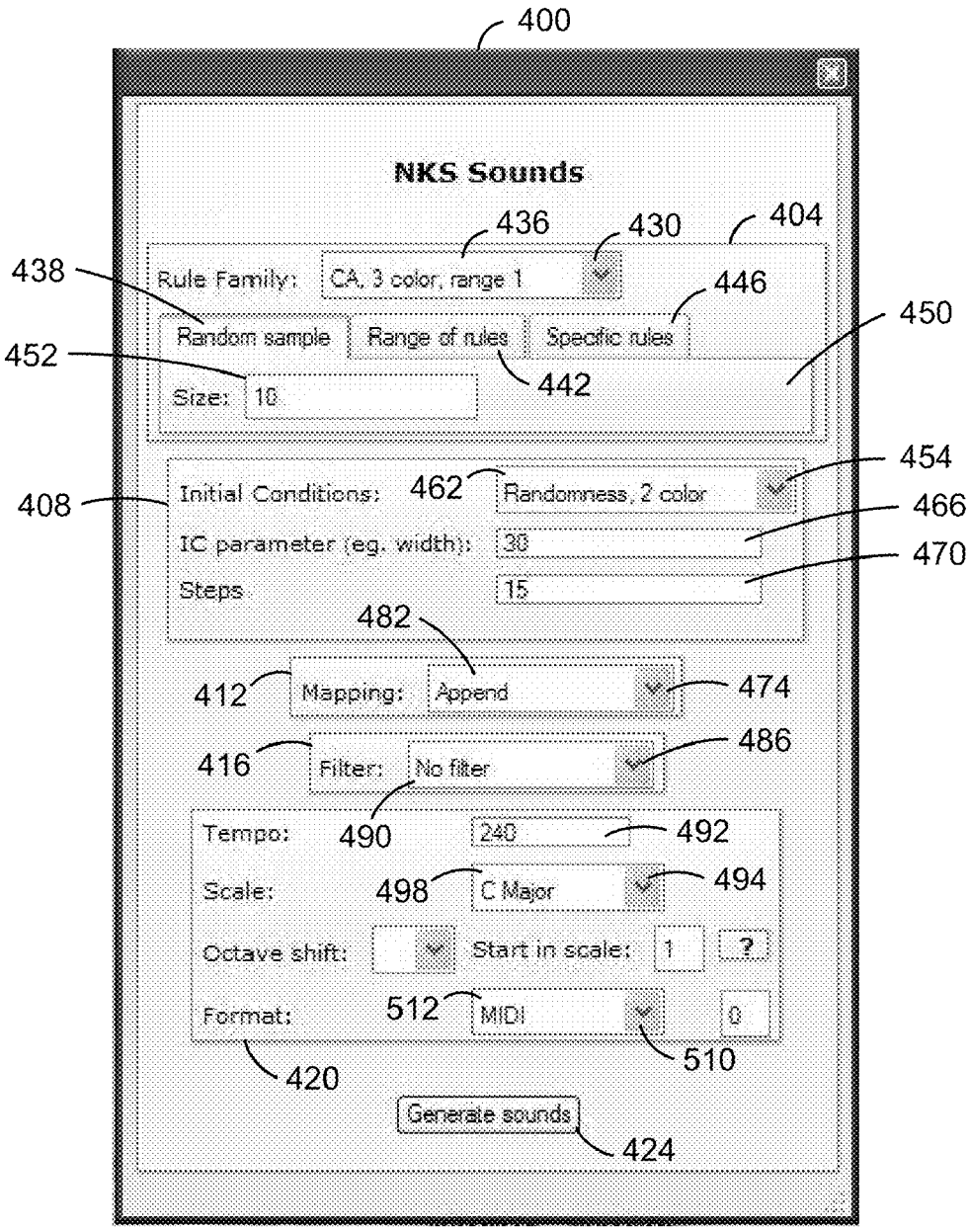
FIG. 6 is an illustration of an example display that may be employed as part of a user interface associated with a system for generating a plurality of signaling tone sequences.

Optionally, generated signaling tone sequences may be processed to remove signaling tone sequences that have been determined to be too similar to other signaling tone sequences. FIG. 6 is a block diagram of yet another example system 270 for generating a plurality of signaling tone sequences. The system 270 includes elements common with the system 200 of FIG. 4, and also includes a similarity filter 274 to remove one or more generated signaling tone sequences that are determined to be too similar to another generated signaling tone sequence. The similarity filter 274 receives signaling tone sequences and then determines if each signaling tone sequence is too similar to one or more other signaling tone sequences. If it is determined that two signaling tone sequences are too similar, the similarity filter 274 removes one of the two signaling tone sequences. Any of a variety of techniques for determining similarity can be used, including known techniques. For example, pattern matching and/or correlation techniques may be utilized, and/or distance measures in the abstract space of musical sequences. For instance, correlations of each signaling tone sequence with the other signaling tone sequences could be generated. If a correlation between two signaling tone sequences is above a threshold, for example, then one of the two signaling tone sequences may be removed. Or a mathematical distance measure function could be written, that takes two sequences and returns a numerical measure of how far apart they are in musical space. If a pair scores above a threshold level, then one of the two sequences could be removed.

Any of the blocks described with reference to FIGS. 1-5 may be implemented using software comprising computer program instructions. Such computer program instructions may control the operation of a computing device such as a desktop computer, a laptop computer, a tablet computer, a workstation, a server, a mainframe, a cellular phone, a telephone, a set top box, a PDA, a pager, a processing system of an electronic toy, a processing system of an electronic game, a processing system of a consumer electronics device, etc. The computing device may have a memory in which the computer program instructions may be stored. The computer program instructions may be written in any high level language such as the Mathematica® programming language, C, C++, C#, Java or the like or any low-level assembly or machine language. By storing computer program instructions in a memory of the computing device, the computing device is physically and/or structurally configured in accordance with the computer program instructions.

User Interface for Generating Signaling Tone Sequences

FIG. 6 is an illustration of an example display 400 that may be employed as part of a user interface associated with a system for generating a plurality of signaling tone sequences. For example, the display 400 could be used to configure systems such as the systems described with reference to FIGS. 3-5. For example, the display 400 could be used by a human operator to determine a particular combination or combinations of recursive systems, mappings, and filters that would result in the generation of a large number of aesthetically acceptable signaling tone sequences. Then, an appropriately configured system could automatically generate a large number of tone sequences with minimal human intervention. As another example, the display 400 could be used by a consumer to interactively generate signaling tone sequences for the consumer's cellular phone, PDA, toy, game, consumer electronics device, etc.

FIG. 6 will be described with reference to FIG. 3 and FIG. 4 for illustrative purposes. It will be understood by those of ordinary skill in the art, however, that the example display 400 can be used in conjunction with other signaling tone sequence generation systems as well, and that other user interfaces can be used with the system 150 of FIG. 3 and/or the system 200 of FIG. 4.

The display 400 includes a portion 404 and a portion 408 to configure a signaling tone sequence generator to generate a plurality of raw data sequences. For example, the portion 404 may be used to configure the raw data sequence generator 154 and/or the rules 158 of FIG. 3. Similarly, the portion 408 may be used to select the initial conditions 162 of FIG. 3. The portions 404 and 408 will be described in more detail below.

The display 400 also includes a portion 412 to configure a signaling tone sequence generator to convert a plurality of raw data sequences into a plurality of signaling tone sequences. For example, the portion 412 may be used to select a mapping specification to be used by the converter 166 of FIG. 3 and/or the tone sequence generator 204 of FIG. 4. The selected mapping specification may indicate how raw data sequences are to be mapped into tone sequences. Similarly, the portion 416 may be used to select a filter specification to be used by the converter 166 of FIG. 3 and/or the filter 212 of FIG. 4. The selected filter specification may incorporate at least some aesthetic music principles, for example. Optionally, the configuration of the raw data sequence generator and/or the rules via the portion 404 and/or the mapping specification selected via the portion 412 may incorporate some of the aesthetic music principles as well. The portions 412 and 416 will be described in more detail below.

Additionally, the display 400 includes a portion 420 for selecting various options for the performance of the signaling tones to be generated. For example, the portion 420 may be used to select options and format information 174 to be used by the converter 166 of FIG. 3 and/or the formatting information 224 used by the formatter 220 of FIG. 4. The portion 420 will be described in more detail below.

The portions 404 and 408 may be used to configure generation of raw data sequences. The portion 412 may be used to configure a mapping of raw data sequences into tone sequences, and the portion 416 may be used to configure a filter to eliminate tone sequences that do not follow a desired set of music principles. The portion 420 may be used to configure a format of the signaling tone sequences that will be generated. Then, a user may select the button 424 to cause signaling tone sequences to be generated.

The portion 404 for configuring a signaling tone sequence generator includes user interface mechanisms for selecting one or more recursive systems for generating the plurality of raw data sequences. For instance, a button 430 enables a user to view a menu listing a plurality of families of recursive systems. A user may then select one of the families from the menu. Then, a raw data sequence generator may be configured to generate raw data sequences using recursive systems from the selected family.

Figure 7:
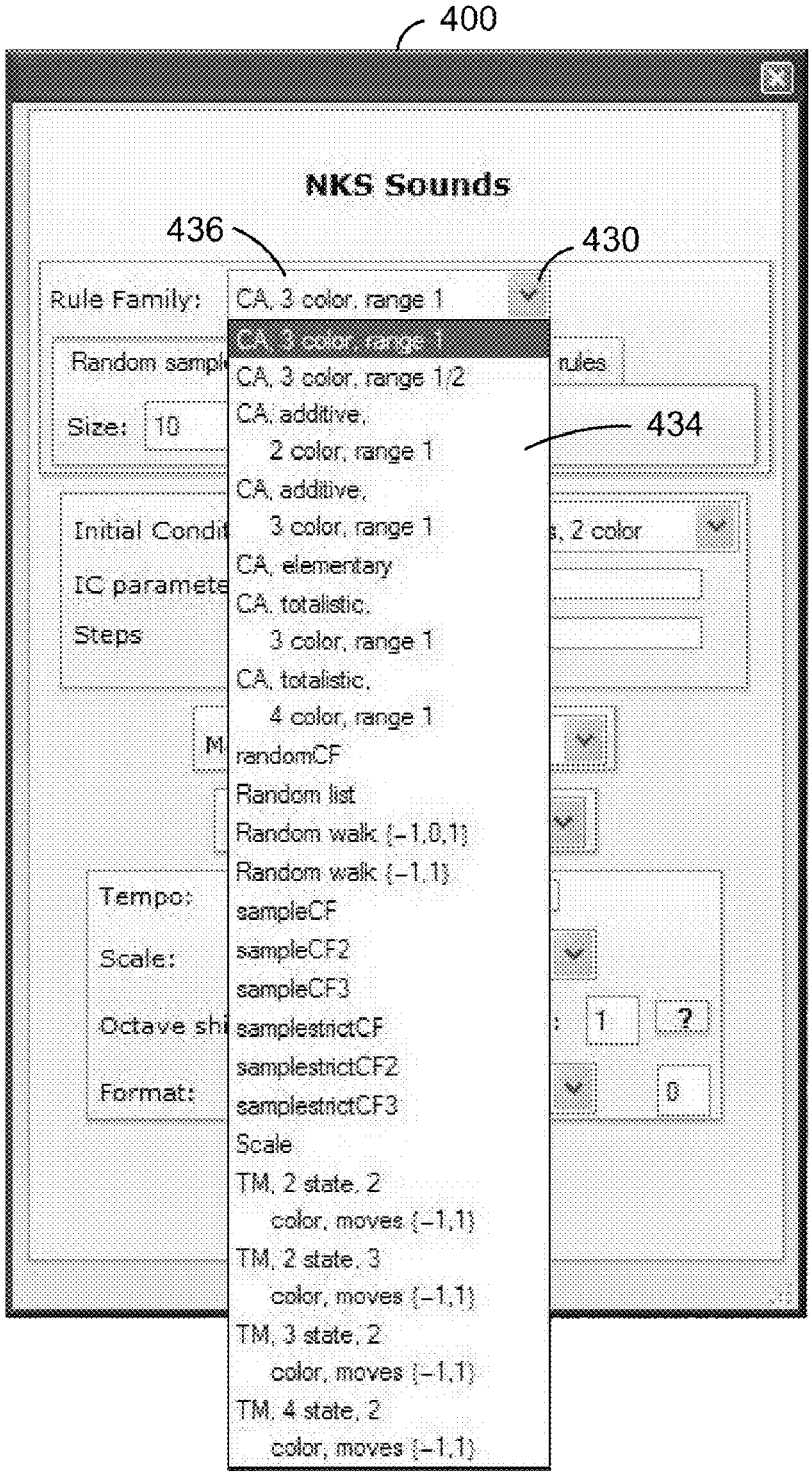
FIG. 7 is an illustration of the example display of FIG. 6 showing a menu listing a plurality of families of recursive systems that may be used to generate a plurality of signaling tone sequences.

FIG. 7 is an illustration of the display 400 after the button 430 has been selected. The display 400 includes a menu 434 listing a plurality of families of recursive systems. For example, the menu 434 lists a plurality of cellular automata families, a plurality of random process system families, a plurality of families of enumerated constraint systems configured to generate sequences that follow at least some of the cantus firmus rules, a plurality of Turing machine system families, etc. After a user selects one of the families from the menu 430, the menu may disappear and the selected family may be displayed in a box 436.

Referring again to FIG. 6, the portion 404 includes a plurality of tabs 438, 442, 446 that facilitate display of user interface functions for further configuring a signaling tone sequence generator. For instance, if the tab 438 is selected, a portion 450 is displayed and the signaling tone sequence generator will be configured to generate raw data sequences using a number of recursive systems randomly selected from the family indicated by the box 436. A text box 452 enables a user to specify the number of recursive systems to be randomly selected.

If the tab 442 is selected, a portion associated with selecting a range of recursive systems will be displayed, and the signaling tone sequence generator will be configured to generate raw data sequences using a selected range of recursive systems from the family indicated by the window 436. Enumerated families of systems or rules have a distinct numerical "name" for each component rule within that family, and so may be specified in blocks by a range of integers. The range may be selected using a variety of user interface mechanisms such as a menu, a text box, buttons, check boxes, etc.

If the tab 446 is selected, a portion associated with selecting particular recursive systems will be displayed, and the signaling tone sequence generator will be configured to generate raw data sequences using a recursive systems selected from the family indicated by the window 436, completely specified by the user e.g. by using its numerical "name". The particular recursive systems may be selected using a variety of user interface mechanisms such as a menu, a text box, buttons, check boxes, etc.

Figure 8:
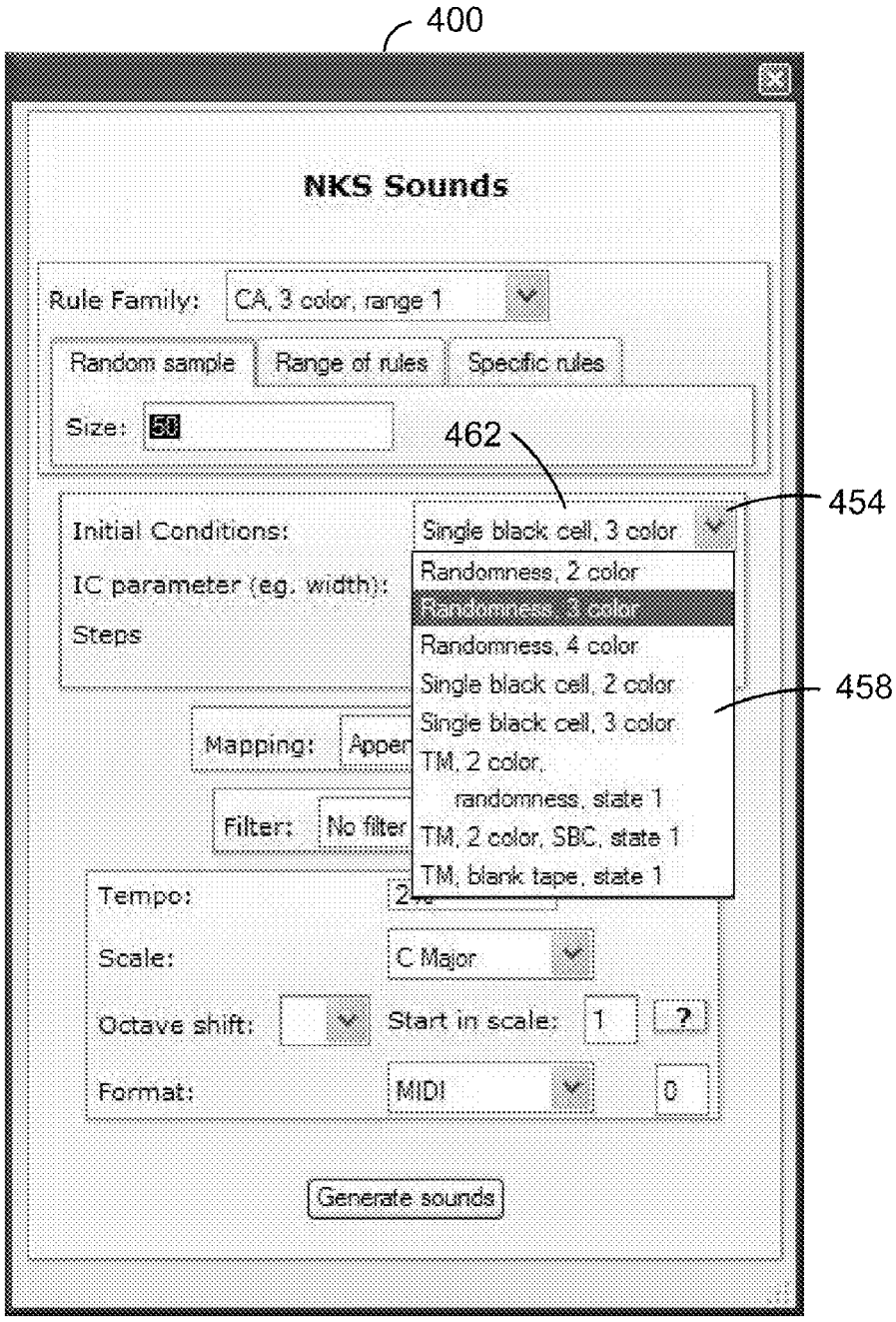
FIG. 8 is an illustration of the example display of FIG. 6 showing a menu listing a plurality of types of initial conditions that may be used to configure a signaling tone sequence generator.

The portion 408 for configuring a signaling tone sequence generator includes user interface mechanisms for selecting one or more initial conditions to be used by a raw data sequence generator. For instance, a button 454 enables a user to view a menu listing a plurality of types of initial conditions. A user may then select one of the types of initial conditions from the menu. FIG. 8 is an illustration of the display 400 after the button 454 has been selected. The display 400 includes a menu 458 listing a plurality of types of initial conditions that may be used to configure a raw data sequence generator. For example, the menu 458 lists a plurality of types of random initial conditions, a plurality of specific initial conditions, a plurality of initial conditions associated with Turing machine systems, etc. After a user selects one of the types of initial conditions from the menu 458, the menu may disappear and the selected initial condition may be displayed in a box 462.

The portion 408 for configuring a raw data sequence generator also includes text boxes 466 and 470 for entering additional configuration information. In particular, the text boxes 466 and 470 enable a user to indicate a number of iterations that each recursive system specified via the portion 404 is to operate. For recursive systems that can be used to generate a two dimensional matrix of data (see, e.g., discussion of cellular automata in A New Kind of Science), the text box 466 can be used to specify a width of the two dimensional array and the text box 470 can be used to specify a height of the array.

As shown in FIG. 6, a raw data sequence generator has been configured to generate ten raw data sequences using ten randomly selected (see text box 452) cellular automata systems from the family "CA, 3 color, range 1" (see box 436). For each cellular automaton system, the raw data sequence generator will use a randomly selected initial condition from the family "Randomness, 2 color" (see text box 462). Each cellular automaton system will generate a two dimensional matrix of data having a width of thirty (see text box 466) and a height of fifteen (see text box 470).

Figure 9:
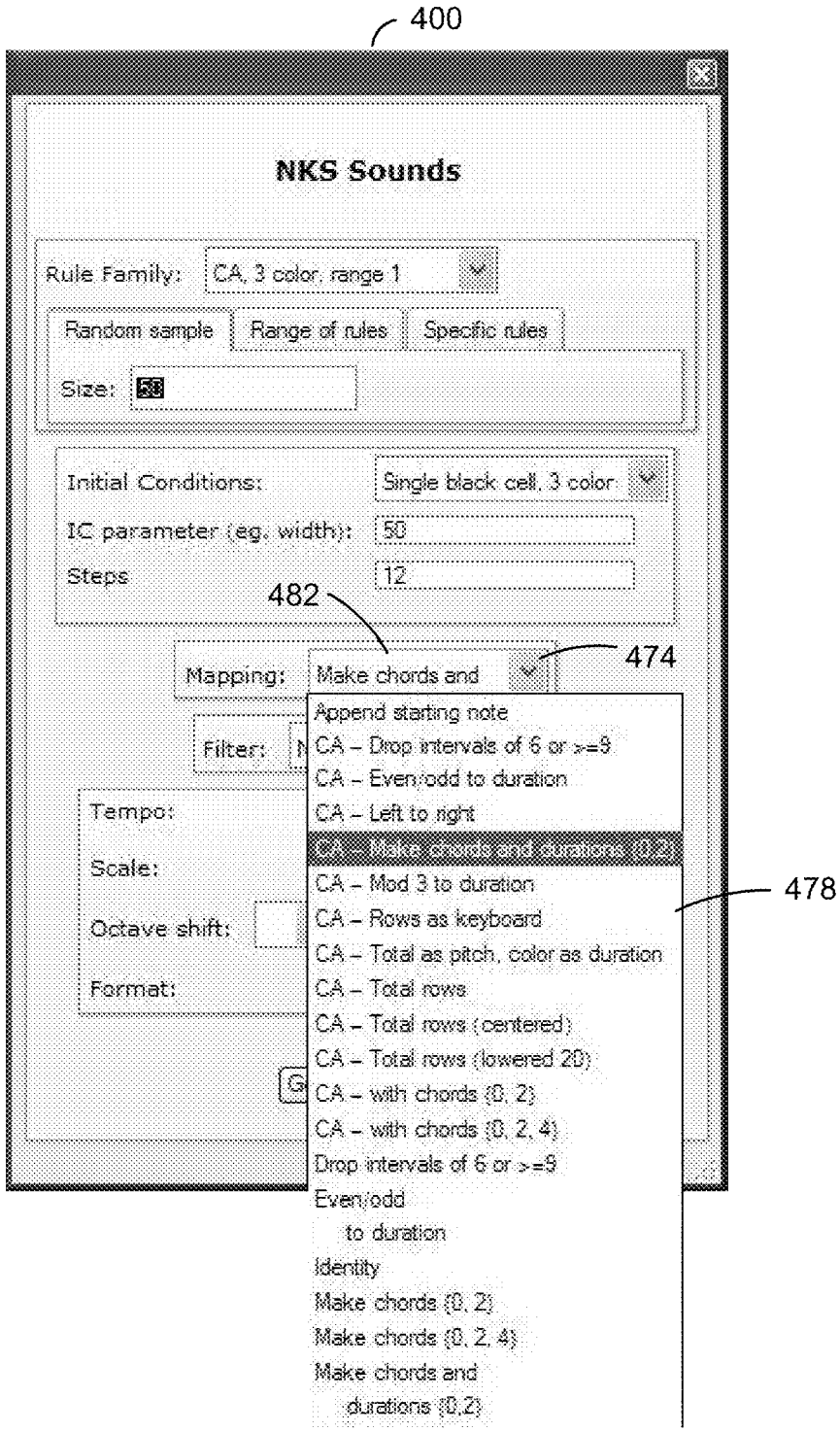
FIG. 9 is an illustration of the example display of FIG. 6 showing a menu listing a plurality of mappings that may be used to convert a plurality of raw data sequences to a plurality of signaling tone sequences.

The portion 412 for configuring a signaling tone sequence generator includes user interface mechanisms for selecting a mapping. For instance, a button 474 enables a user to view a menu listing a plurality of mappings. A user may then select one of the mappings from the menu. FIG. 9 is an illustration of the display 400 after the button 474 has been selected. The display 400 includes a menu 478 listing a plurality of mappings. After a user selects one of the mappings from the menu 478, the menu may disappear and the selected mapping may be displayed in a box 482.

Figure 10:
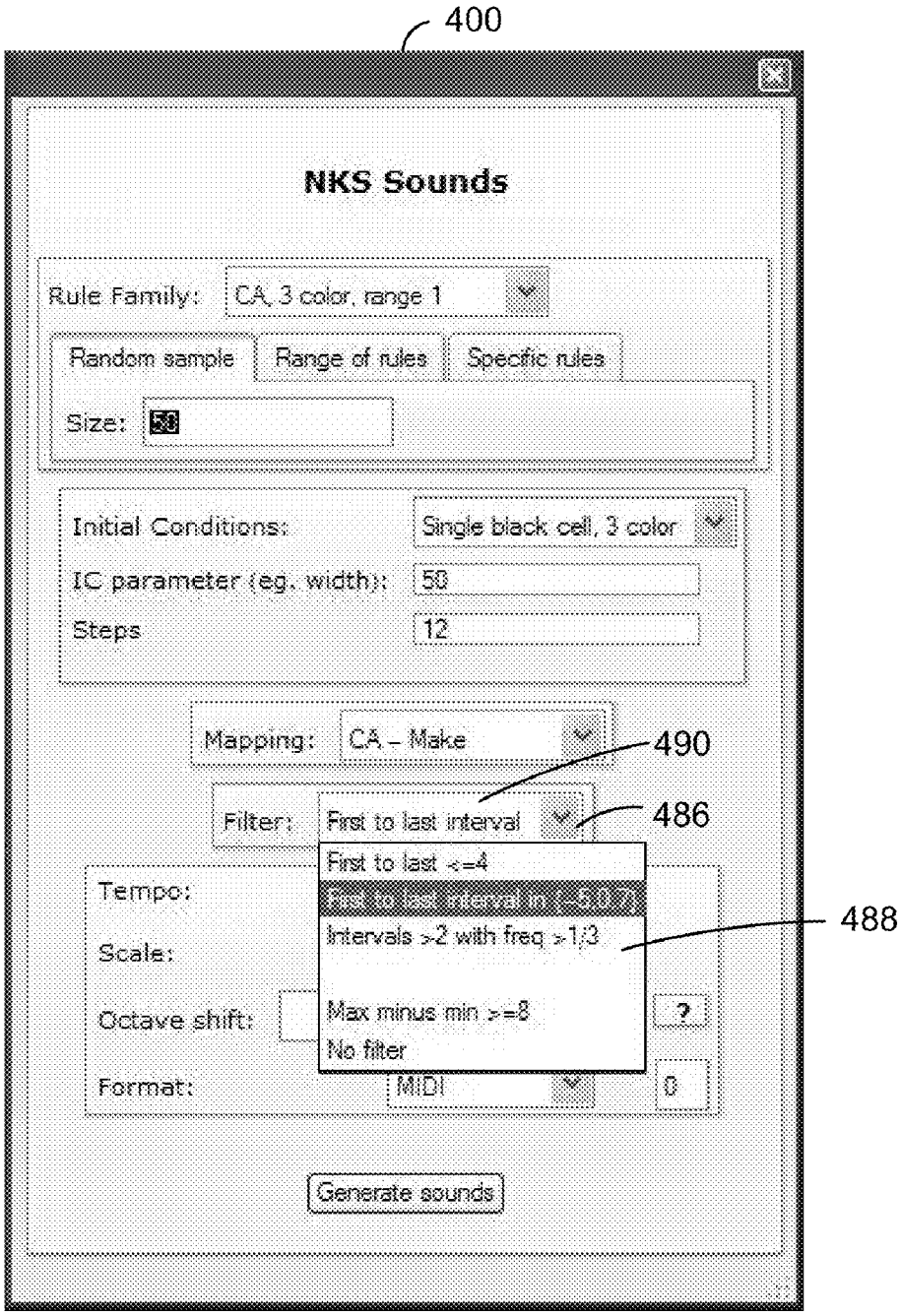
FIG. 10 is an illustration of the example display of FIG. 6 showing a menu listing a plurality of filters that may be used to remove tone sequences that do not follow a set of aesthetic music principles.

The portion 416 for configuring a signaling tone sequence generator includes user interface mechanisms for selecting a filter. For instance, a button 486 enables a user to view a menu listing a plurality of filters. A user may then select one of the filters from the menu. FIG. 10 is an illustration of the display 400 after the button 486 has been selected. The display 400 includes a menu 488 listing a plurality of filters. After a user selects one of the filters from the menu 488, the menu may disappear and the selected filter may be displayed in a box 490.

As shown in FIG. 6, a signaling tone sequence generator has been configured to generate tone sequences from raw data sequences using a mapping "Append" (see box 422). Also, the tone sequences will not be filtered (see box 490). On the other hand, as shown in FIG. 10, the signaling tone sequence generator has been configured to filter tone sequences using a filter "first to last interval in {−5, 0, 7}" (see box 490).

Referring again to FIG. 6, the portion 420 for configuring a signaling tone sequence generator includes user interface mechanisms for specifying a format of signaling tone sequences. For example, a text box 492 enables a user to specify a tempo of the signaling tone sequences to be generated. Also, a button 494 enables a user to view a menu listing a plurality of musical scales. A user may then select one of the musical scales from the menu. After selection of a musical scale, the signaling tone sequence generator will be configured to generate signaling tone sequence in the selected musical scale.

Figure 11:
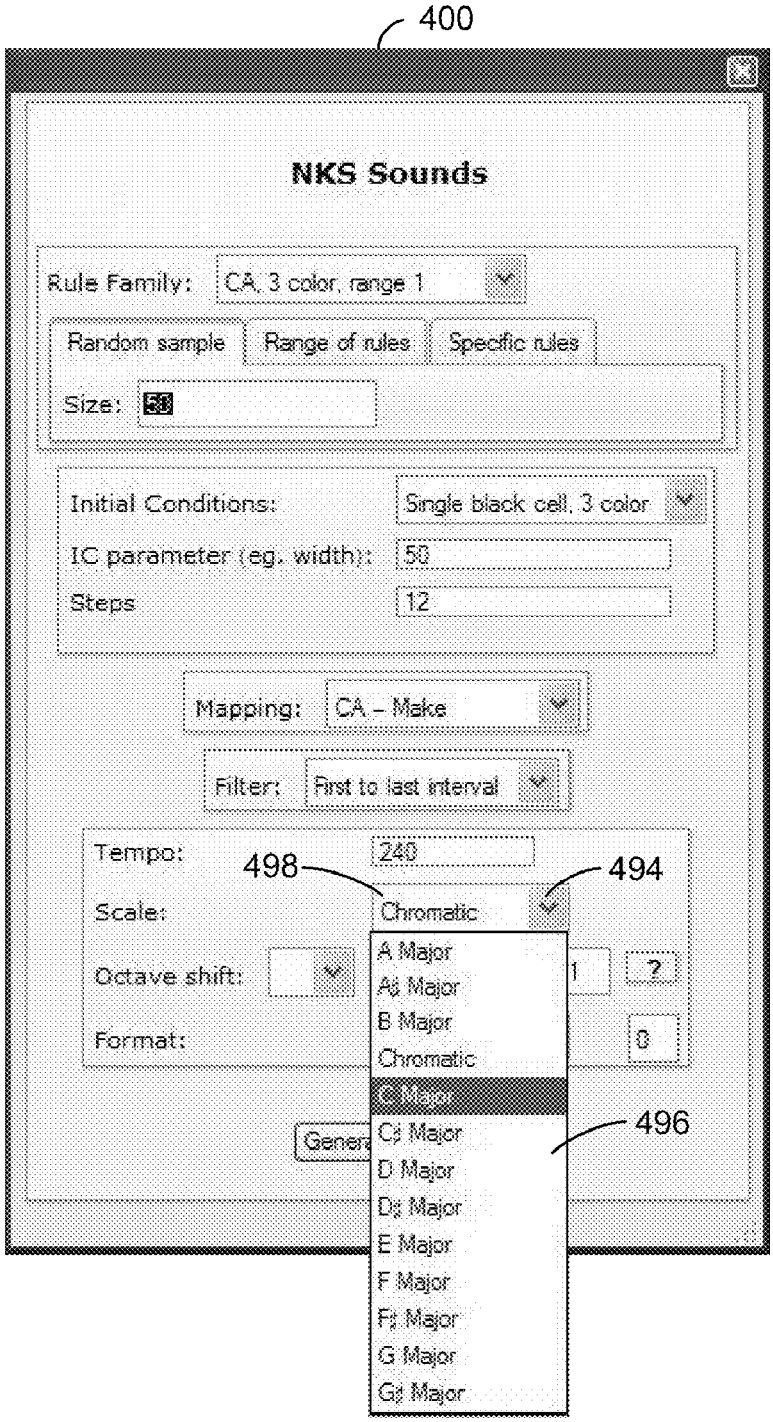
FIG. 11 is an illustration of the example display of FIG. 6 showing a menu listing a plurality of musical scales in which signaling tone sequences may be generated.

FIG. 11 is an illustration of the display 400 after the button 494 has been selected. The display 400 includes a menu 496 listing a plurality of musical scales. After a user selects one of the musical scales from the menu 496, the menu may disappear and the selected musical scale may be displayed in a box 498. Additionally, the portion 420 includes a button 510 that enables a user to view a menu listing a plurality of data formats for the generated signaling tone sequences. A user may then select one of the data formats from the menu. The data audio format will then be displayed in a box 512.

It is to be understood that the user interface described above with reference to FIGS. 6-11 is merely one example of a user interface that can be utilized. One of ordinary skill in the art will recognize many modifications are possible. As merely one example, different user interface mechanisms than those described above could be used. For instance, buttons, check boxes, separate windows, etc., could be used to select items from a list. Additionally, text boxes could be replaced with menus, buttons, check boxes, separate windows, etc. If a user interface is to be utilized by consumers, the options provided could be simplified and/or put in layman's terms. For example, the user interface could permit choosing from a set of musical genres, choosing a level of musical complexity (e.g., low, medium, or high complexity), choosing from a set of rates (e.g., slow, medium, or fast), choosing from a set of filter levels (e.g., low, medium, or high rejection level), etc.

A user interface such as the user interface described with reference to FIGS. 6-11 may be implemented using software comprising computer program instructions. Such computer program instructions may control the operation of a computing device such as a desktop computer, a laptop computer, a tablet computer, a workstation, a server, a mainframe, a kiosk, a cellular phone, a telephone, a set top box, a PDA, etc. The computing device may have a memory in which the computer program instructions may be stored. The computer program instructions may be written in any high level language such as the Mathematica® programming language, C, C++, C#, Java, hypertext markup language (HTML), extensible markup language (XML), or the like or any low-level assembly or machine language. By storing computer program instructions in a memory of the computing device, the computing device is physically and/or structurally configured in accordance with the computer program instructions. Some or all of the computer program instructions that are used to generate a user interface display such as in FIGS. 6-11 may be executed by the device that actually displays the user interface display or by a separate device. For example, a user interface display could comprise a web page provided to a computing device by a server.

Delivery of Signaling Tone Sequences

Signaling tone sequences generated according to a method such as the method 100 of FIG. 1 may be delivered to devices and/or systems that will utilize the signaling tone sequences in a variety of ways. For example, if the method 100 is implemented by a maker of devices such as cellular phones, the signaling tone sequences may be delivered to manufactured cellular phones via a data communication network at a manufacturing facility of the cellular phone maker. Optionally, the method 100 may be implemented by a third party provider. In this case, the third party may deliver a subset of generated signaling tone sequences to the device maker via a communications network such as the Internet, and the device maker can then deliver the subset of signaling tone sequences to the manufactured devices via a data communication network at a manufacturing facility of the device maker. Also, a signaling device user may obtain signaling tone sequences from a manufacturer, service provider, third-party provider of signaling tone sequences, etc.

Figure 12:
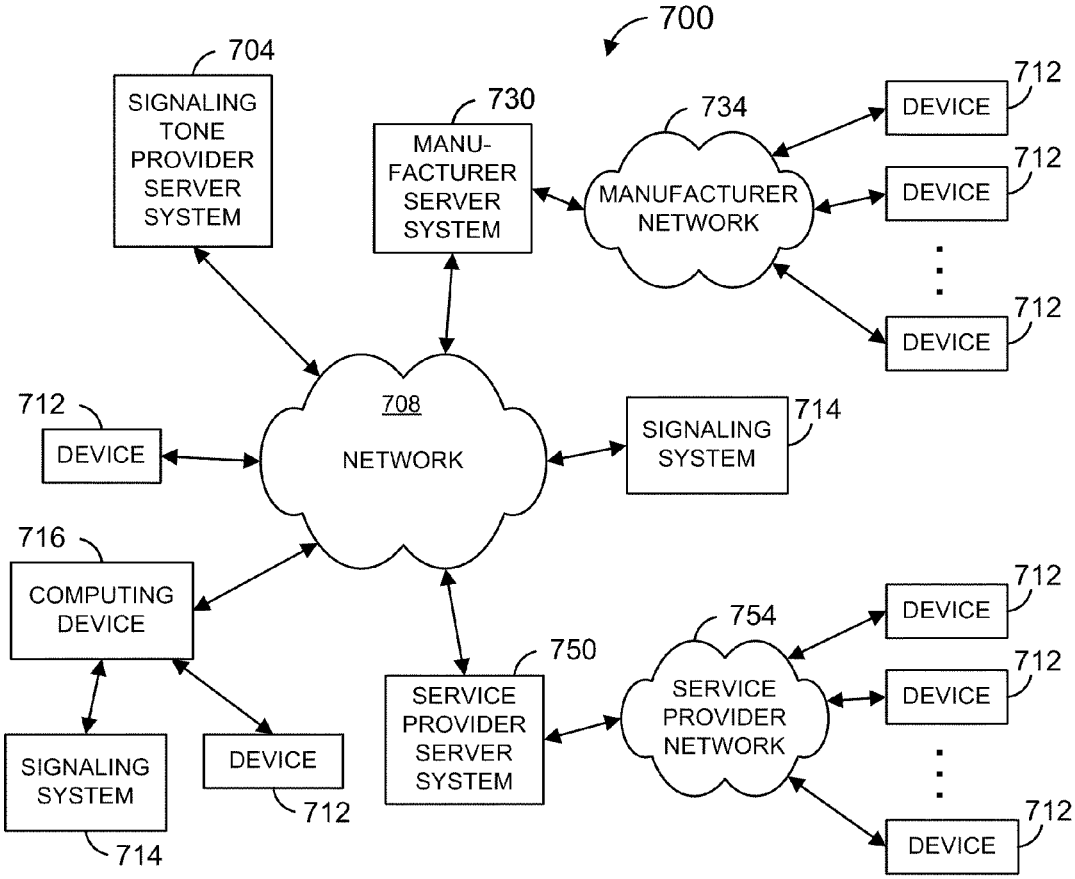
FIG. 12 is a block diagram of an example system in which signaling tone sequences may be delivered to signaling devices and/or signaling systems.

FIG. 12 is a block diagram of an example system 700 in which signaling tone sequences generated according to a method such as the method 100 of FIG. 1 may be delivered to signaling devices and/or signaling systems. The system 700 comprises a signaling tone provider server system 704 communicatively coupled to a network 708. Via the network, signaling tone sequences may be delivered from signaling tone server system 704 to one or more signaling devices 712 and/or one or more signaling systems 714.

The server system 704 may comprise one or more servers. The server system 704 may store information, receive information via the network 708, and disseminate information via the network 708. For example, the server system 704 may store a plurality of signaling tone sequences. Additionally, the server system 704 may deliver signaling tone sequences to one or more signaling devices 712 and/or one or more signaling systems 714 via the network 708. Also, the server system 704 may permit a user, a manufacturer, a service provider, etc., to select a single signaling tone sequence, a handful of signaling tone sequences, a very large number of signaling tone sequences, etc., for delivery. For example, the server system 704 may provide web pages, a user interface, etc., to permit generation and/or selection of signaling tone sequences for delivery. The network 708 may comprise one or more of a local area network (LAN), an intranet, an extranet, a wide area network (WAN), a hardwired network, a wireless network, the Internet, etc.

In one implementation, the signaling tone provider server system 704 may generate signaling tone sequences. For example, the signaling tone provider server system 704 may implement a method such as the method 100 of FIG. 1. Also, the signaling tone provider server system 704 may implement a system such as the system 150 of FIG. 3. Additionally or alternatively, signaling tone sequences may be generated by a system separate from the server system 704 and delivered to the server system 704. Optionally, the signaling tone provider server system 704 may implement a user interface such as the user interface described with reference to FIGS. 6-11.

The signaling devices 712 may comprise, for example, telephones, cellular phones, pagers, PDAs, two way radios, set top boxes, desktop computers, laptop computers, tablet computers, toys, games, electronic consumer devices, etc. A signaling device 712 may couple to the network 708 in a variety of ways. If a signaling device 712 includes, for example, a wireless network interface device, a wired network interface device, a modem, etc., the signaling device 712 may directly couple with the network 708. Thus, the signaling tone provider server system 704 may deliver signaling tone sequences to a signaling device 712 via the network 708 and via a wired or wireless connection of the signaling device 712 to the network 708. Alternatively, a signaling device 712 may couple with a computing device 716 via a link such as a wired link (e.g., wires, a cord, a cradle, a Universal Serial Bus (USB) link, etc.) or a wireless link (e.g., an infrared link, a Bluetooth™ communications link, a wireless LAN, etc.). The computing device 716 may in turn be communicatively coupled to the network 708. Thus, the signaling tone provider server system 704 may deliver signaling tone sequences to the computing device 716, which in turn delivers the signaling tone sequences to the signaling device 712.

The server system 704 may interact with the devices 712 and/or computing devices such as the computing device 716. For example, in one implementation, a person, via a device 712 and/or the computing device 716, may request from the server system 704 one or more signaling tone sequences. Optionally, the person, via a device 712 and/or the computing device 716, may select the particular signaling tone sequence(s) from the server system 704 to be delivered. In response, the server system 704 may deliver signaling tone sequences to the device 712 or the computing device 716 via the network 708. In this implementation, the device 712 or the computing device 716 may execute an application which may permit the person to view and interact with web pages, displays, etc., delivered by the server system 704.

The signaling systems 714 may comprise, for example, paging systems, public address systems, intercom systems, etc. A signaling system 714 may couple to the network 708 in a variety of ways. If a signaling system 714 includes, for example, a wireless network access device, a wired network access device, etc., the signaling system 714 may directly couple with the network 708. Thus, the signaling tone provider server system 704 may deliver signaling tone sequences to a signaling system 714 via the network 708 and via a wired or wireless connection of the signaling system 714 to the network 708. Alternatively, a signaling system 714 may couple with a computing device 716 via a link such as a wired link (e.g., wires, a cord, a cradle, a Universal Serial Bus (USB) link, a local area network (LAN), etc.) or a wireless link (e.g., an infrared link, a Bluetooth™ communications link, a wireless LAN), etc. The computing device 716 may in turn be communicatively coupled to the network 708. Thus, the signaling tone provider server system 704 may deliver signaling tone sequences to the computing device 716, which in turn delivers the signaling tone sequences to the signaling system 714.

Some of the signaling devices 712, the signaling systems 714, and/or the computing device 716 may include, for example, web browsing software for interacting with the server system 704. In these implementations, the web browsing software may permit the signaling device 712, the signaling system 714, and/or the computing device 716 to display web pages and allow a person to select signaling tone sequences for delivery to the signaling device 712, the signaling system 714, and/or the computing device 716. In other implementations, some of the signaling devices 712, the signaling systems 714, and/or the computing device 716 may include specialized and/or dedicated software for interacting with the server system 704. Optionally, a person could use a computing system 716 to select signaling tone sequences for delivery to a signaling device 712 or a signaling system 714 not coupled to the computing system 716. For example, the person could use the computing device 716 to specify the device 712 or a signaling system 714 to which signaling tone sequences are to be delivered. For instance, the person could specify a phone number, an e-mail address, a network address, an Internet Protocol (IP) address, a web address, etc., associated with a signaling device 712 or signaling system 714. Further, the server system 704 may permit a person to generate signaling tone sequences via the signaling device 712, the signaling system 714, and/or the computing device 716. For example, the server system 704 could provide a user interface, such as the user interface described with reference to FIGS. 6-11, via a website that permits a person to interactively generate signaling tone sequences.

In some implementations, the system 700 may include a manufacturing server system 730 associated with a manufacture of signaling devices 712. The server system 730 may comprise one or more servers and may be located, at least partially, at a manufacturing facility. For example, one or more servers of the server system 730 may be located at the manufacturing facility and one or more servers may be located elsewhere. The server system 730 may store information, receive information via the network 708, and disseminate information via the network 708 as well as a network 734. For example, the manufacturer server system 730 may interact with the signaling tone provider server system 704 to receive a plurality of signaling tone sequences from the signaling tone provider server system 704 via the network 708. Then, the manufacturer server system 730 could deliver signaling tone sequences to a plurality of signaling devices 712 in a manufacturing facility via the network 734.

The network 734 may comprise a communication network that communicatively couples signaling devices 712 manufactured and/or processed at a manufacturing facility with the server system 730. The network 734 may comprise one or more of a LAN, an intranet, an extranet, a WAN, a hardwired network, a wireless network, the Internet, etc.

In some implementations, the system 700 may include a service provider server system 750 associated with a provider of communication services that utilize signaling devices 712. The server system 750 may comprise one or more servers, may store information, receive information via the network 708, and disseminate information via the network 708 as well as a network 754. For example, the service provider server system 750 may interact with the signaling tone provider server system 704 to receive a plurality of signaling tone sequences from the signaling tone provider server system 704 via the network 708. Then, the service provider server system 750 could deliver signaling tone sequences to a plurality of signaling devices 712 via the network 754.

The network 754 may comprise a communication network operated and/or utilized by the service provider in providing communication services. The network 754 may permit the server system 750 to communicatively couples to signaling devices 712. The network 754 may comprise one or more of a cellular phone network, a telephone network, a paging network, a satellite network, a cable television network, a LAN, a wireless LAN, a WAN, a hardwired network, a wireless network, the Internet, etc.

The computing system 716 may comprise, for example, a desktop computer, a laptop computer, a kiosk, a workstation, a server, a mainframe, a minicomputer, a multiprocessor system, a distributed computing system, a PDA, a cellular phone, a two-way pager, a programmable consumer electronics device, a network personal computer (PC), or any other device capable of accessing information via the network 708. Each of the computing system 716, the server system 730, and the server system 750 may be linked with the network 708 via a communication link, which may comprise, for example, one or more of a hardwired link, a wireless link, a traditional telephone line, an ISDN line, a DSL link, a T1 line, a T3 line, a cable television line, a cellular link, a two-way pager link, a microwave link, a satellite link, etc. In another implementation, one or more of the signaling devices 712, the signaling systems 714, the computing system 716, the server system 730, and the server system 750 may be linked directly to the signaling tone server system 704 via a direct communications link (not shown).

Optionally, the computing system 716, the server system 730, and/or the server system 750 may generate signaling tone sequences and may implement a method such as the method 100 of FIG. 1 and/or a system such as the system 150 of FIG. 3. Similarly, the computing system 716, the server system 730, and/or the server system 750 may implement a user interface such as the user interface described with reference to FIGS. 6-11.

The concepts of "client" and "server," as used in this application and in industry are very loosely defined and, in fact, are not fixed with respect to machines or software processes executing on the machines. Typically, a server is a machine or process that is providing information to another machine or process, i.e., the "client," that requests the information. In this respect, a computer or process can be acting as a client at one point in time (because it is requesting information) and can be acting as a server at another point in time (because it is providing information). Some computers are consistently referred to as "servers" because they usually act as a repository for a large amount of information that is often requested. For example, a web site is often hosted by a server computer with a large storage capacity, a high-speed processor or processors and a network link having the ability to handle many high-bandwidth communication links.

It is to be understood that the system 700 of FIG. 12 is only one example of a system that may be used to deliver signaling tone sequences to signaling devices and/or signaling systems. For instance, in another system, one or both of the server systems 730 and 750 may be omitted. Similarly, one or both of the networks 734 and 754 may be omitted. One of ordinary skill in the art will recognize many other modifications, variations, etc.

Figure 13:
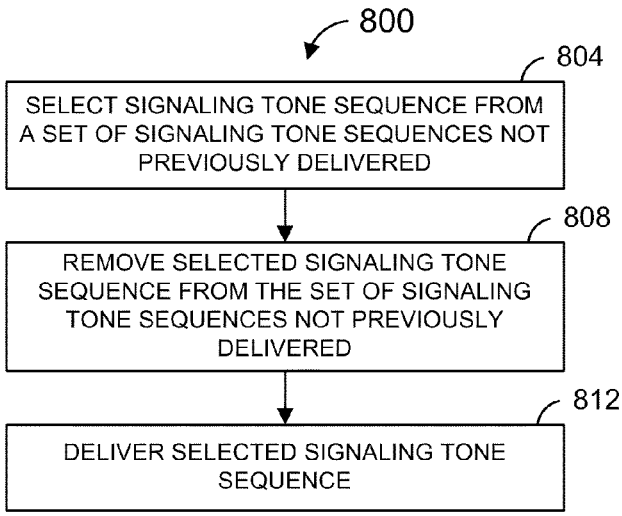
FIG. 13 is a flow diagram of an example method for delivering a signaling tone sequence.

It may be desirable to ensure that a signaling tone sequence to be delivered to a signaling device or signaling system has not been or will not be delivered to another signaling device and/or signaling system or to another signaling device and/or signaling system in a set of signaling devices. For example, a cellular phone manufacturer may want to ensure that a signaling tone sequence has not been or will not be delivered to any other signaling devices and signaling systems, any other cellular phone, any other cellular phone made by the manufacturer, etc. FIG. 13 is a flow diagram of an example method 800 to help ensure that the signaling tone sequence has not been or will not be delivered to another signaling device and/or signaling system in a set of signaling devices. The method 800 could be implemented by the signaling tone provider server system 704, the manufacturer server system 730, the service provider server system 750, and/or the computing system 716 of FIG. 12, for example. The method 800 will be described with reference to FIG. 12 for illustrative purposes.

At a block 804, a signaling tone sequence may be selected from a set of signaling tone sequences that have not previously been delivered. For example, the signaling tone provider server system 704 may select a signaling tone sequence in response to a request for a signaling tone sequence from a signaling device 712, a signaling system 714, the computing system 716, the manufacturer server system 730, or the service provider server system 750. As another example, the computing device 716, the manufacturer server system 730, or the service provider server system 750 may select a signaling tone sequence.

At a block 808, the selected signaling tone sequence may be removed from the set of signaling tone sequences not previously delivered. The selected signaling tone sequence may be removed, for example, by deleting the signaling tone sequence, marking the signaling tone sequence as having been delivered, etc. The block 808 may be implemented by the signaling tone provider server system 704, the computing device 716, the manufacturer server system 730, or the service provider server system 750, for instance.

At a block 812, the signaling tone sequence selected at the block 804 may be delivered. For example, the signaling tone provider server system 704 may deliver the selected signaling tone sequence to a signaling device 712, a signaling system 714, the computing system 716, the manufacturer server system 730, or the service provider server system 750. As another example, the computing device 716 may deliver the selected signaling tone sequence to a signaling device. As yet another example, the manufacturer server system 730 may deliver the selected signaling tone sequence to a signaling device via the network 734. Similarly, the service provider server system 750 may deliver the selected signaling tone sequence to a signaling device 712 via the network 754.

One of ordinary skill in the art will recognize many variations and modifications to the method 800. For example, a plurality of signaling tone sequences could be selected at the block 804. Then, the plurality of selected signaling tone sequences could be removed from the set of signaling tone sequences not previously delivered. Finally, the plurality of selected signaling tone sequences could be delivered. Other variations and modifications are possible. For example, the order of the blocks 808 and 812 could be reversed.

While many methods and systems have been described herein as being implementable in software, they may be implemented in hardware, firmware, etc., and may be implemented by a variety of computing systems and devices. Thus, the method blocks and system blocks described herein may be implemented in a standard multi-purpose central processing unit (CPU), a special purpose CPU, or on specifically designed hardware or firmware such as an application-specific integrated circuit (ASIC) or other hard-wired device as desired. When implemented in software, the software routine may be stored in any computer readable memory such as on a magnetic disk, a laser disk (such as a compact disk (CD), a digital versatile disk (DVD)), a flash memory, a memory card, a memory stick, etc., or other storage medium, in a RAM or ROM of a computer or processor, in any database, etc. Likewise, this software may be delivered via any known or desired delivery method including, for example, on a computer readable memory or other transportable computer storage mechanism or over a communication channel such as a telephone line, the internet, etc. (which are viewed as being the same as or interchangeable with providing such software via a transportable storage medium).

The present disclosure has been described with reference to specific examples, which are intended to be illustrative only and not to be limiting. It will be apparent to those of ordinary skill in the art that changes, additions or deletions may be made to the disclosed examples without departing from the spirit and scope of the disclosure.

What is claimed is:

1. A method for delivering signaling tones to signaling devices or signaling systems, the method comprising the acts of:

selecting a signaling tone sequence from a set of undelivered signaling tone sequences stored in a database;

removing the selected signaling tone sequence from the set of undelivered signaling tone sequences; and delivering the selected signaling tone sequence via a communication network, wherein the set of undelivered signaling tone sequences in the database have been generated by generating a plurality of raw data sequences using at least one recursive system and converting the plurality of raw data sequences into the set of undelivered signaling tone sequences, wherein each signaling tone sequence in the set of undelivered signaling tone sequences follows a set of musical principles.

2. A method according to claim 1, wherein removing the selected signaling tone sequence comprises the act of deleting the selected signaling tone sequence.

3. A method according to claim 1, wherein removing the selected signaling tone sequence comprises the act of marking the selected signaling tone sequence as having been delivered.

4. A method according to claim 1, wherein delivering the selected signaling tone sequence comprises the act of delivering the selected signaling tone sequence to one of a telephone, a cellular phone, a pager, a two-way radio, a personal digital assistant, a toy, a game, a consumer electronics device, a paging system, a public address system, and intercom system.

5. A method according to claim 1, wherein delivering the selected signaling tone sequence comprises the act of delivering the selected signaling tone sequence to one of a server system associated with a manufacturer of signaling devices and a server system associated with a provider of a communication system that utilizes signaling devices.

6. A computer readable medium having stored thereon machine executable instructions, the machine executable instructions capable of causing the machine to:

select a signaling tone sequence from a set of undelivered signaling tone sequences;

remove the selected signaling tone sequence from the set of undelivered signaling tone sequences; and deliver the selected signaling tone sequence via a communication network, wherein the set of undelivered signaling tone sequences have been generated by generating a plurality of raw data sequences using at least one recursive system and converting the plurality of raw data sequences into the set of undelivered signaling tone sequences, wherein each signaling tone sequence in the set of undelivered signaling tone sequences follows a set of musical principles.

7. A system for delivering signaling tones to signaling devices or signaling systems, comprising:

a server system coupled to a network, the server system configured to:

store a plurality of signaling tone sequences, select a signaling tone sequence from a set of undelivered signaling tone sequences, remove the selected signaling tone sequence from the set of undelivered signaling tone sequences, and deliver the selected signaling tone sequence via the network, wherein the plurality of signaling tone sequences have been generated by generating a plurality of raw data sequences using at least one recursive system and converting the plurality of raw data sequences into the plurality of signaling tone sequences, wherein each signaling tone sequence in the plurality of signaling tone sequences follows a set of musical principles.

8. A system according to claim 7, wherein the server system is configured to delete the selected signaling tone sequence.

9. A system according to claim 7, wherein the server system is configured to mark the selected signaling tone sequence as having been delivered.

10. A system according to claim 7, wherein the server system is configured to f deliver the selected signaling tone sequence to one of a telephone, a cellular phone, a pager, a two-way radio, a personal digital assistant, a toy, a game, a consumer electronics device, a paging system, a public address system, and intercom system.

11. A method according to claim 7, wherein the server system is configured to deliver the selected signaling tone sequence to one of a server system associated with a manufacturer of signaling devices and a server system associated with a provider of a communication system that utilizes signaling devices.

12. A method according to claim 1, wherein at least some of the set of undelivered signaling tone sequences in the database have been generated by at least one of a and b:

a) using a filter configured with at least some of the musical principles from the set of the musical principles to eliminate raw data sequences that would result in signaling tone sequences that did not follow the at least some of the musical principles; and b) converting the plurality of raw data sequences into a plurality of potential signaling tone sequences, and selecting, from the plurality of potential signaling tone sequences, signaling tone sequences that followed the set of musical principles.

13. A method according to claim 1, wherein at least some of the set of undelivered signaling tone sequences in the database have been generated by mapping the plurality of raw data sequences into a plurality of signaling tone sequences.

14. A method according to claim 1, wherein at least some of the set of undelivered signaling tone sequences in the database have been generated using a recursive system configured according to at least some of the musical principles in the set of musical principles so that the recursive system generates only raw data sequences that, when mapped into signaling tone sequences, results in signaling tone sequences that followed at least some of the musical principles in the set of musical principles.

15. A system according to claim 7, wherein at least some of the plurality of signaling tone sequences have been generated using at least one of a and b:

a) a filter configured with at least some of the musical principles from the set of the musical principles to eliminate raw data sequences that result in signaling tone sequences that do not follow the at least some of the musical principles; and b) a converter to convert the plurality of raw data sequences into a plurality of potential signaling tone sequences, and a filter to eliminate tone sequences that do not follow at least some musical principles in the set of musical principles.

16. A system according to claim 7, wherein at least some of the plurality of signaling tone sequences have been generated using a mapper to map raw data sequences into signaling tone sequences.

17. A system according to claim 7, wherein at least some of the plurality of signaling tone sequences have been generated using at least one recursive system configured according to at least some of the musical principles in the set of musical principles so that the recursive system generates only raw data sequences that, when mapped into signaling tone sequences, resulted in signaling tone sequences that followed at least some of the musical principles in the set of musical principles.

* * * * *